United States Patent [19]

Kubo et al.

[11] 4,023,991

[45] May 17, 1977

[54] ANISOTROPIC PERMANENT MAGNET OF MN-AL-C ALLOY

[75] Inventors: Takao Kubo, Kawachinagano; Tadao Ohtani, Katano; Shigeru Kojima, Kyoto; Nobuyuki Kato, Katano; Kiyoshi Kojima; Yoichi Sakamoto, both of Hirakata; Isago Konno; Masaharu Tsukahara, both of Neyagawa, all of Japan

[73] Assignee: Matsushita Electric Industrial Co., Ltd., Osaka, Japan

[22] Filed: June 1, 1976

[21] Appl. No.: 692,020

Related U.S. Application Data

[62] Division of Ser. No. 491,498, July 23, 1974, Pat. No. 3,976,519.

[30] Foreign Application Priority Data

Aug. 2, 1973 Japan ..... 48-87391
Sept. 19, 1973 Japan ..... 48-106311

[52] U.S. Cl. ..... 148/120; 75/134 M; 148/31.57; 148/121

[51] Int. Cl.[2] ..... H01F 1/00; C22C 28/00

[58] Field of Search ..... 148/120, 121, 31.57; 75/134 M

[56] References Cited

UNITED STATES PATENTS

| | | | |
|---|---|---|---|
| 3,116,181 | 12/1963 | Hokkeling | 75/134 M |
| 3,661,567 | 5/1972 | Yamamoto | 75/134 M |
| 3,730,784 | 5/1973 | Yamamoto | 75/134 M |
| 3,976,519 | 8/1976 | Kubo et al. | 148/120 |

*Primary Examiner*—Walter R. Satterfield
*Attorney, Agent, or Firm*—Wenderoth, Lind & Ponack

[57] ABSTRACT

An anisotropic permanent magnet of an Mn-Al-C alloy containing 68.0% to 73.0% by weight of manganese, (1/10Mn-6.6)% to (1/3Mn-22.2)% by weight of carbon, and the remainder aluminum, which alloy is rendered anisotropic by deforming it plastically at a temperature of 530° to 830° C.

The permanent magnet has excellent mechanical characteristics and magnetic properties such that the (BH) max is above $4.8 \times 10^6$ G.Oe up to about $9.2 \times 10^6$ G.Oe in its bulk state.

18 Claims, 8 Drawing Figures

ANISOTROPIC PERMANENT MAGNET OF MN-AL-C ALLOY

This is a division of application Ser. No. 491,498, filed July 23, 1974 now U.S. Pat. No. 3,976,519.

BACKGROUND OF THE INVENTION

This invention relates to permanent magnets and more particularly to anisotropic permanent magnets of manganese-aluminum-carbon (Mn-Al-C) alloys.

Previously known Mn-Al alloy magnets consisting of Mn 60~75 weight % (hereinafter referred to simply as %) and the remainder aluminum are such that the ferromagnetic metastable phase (face-centered tetragonal. lattice constant $a$=3.94A, $c$ = 3.58$A$, $c/a$ = 0.908 and a Curie point of 350° to 400° C; hereinafter referred to as the $\tau$phase) is obtained by way of a heat treatment such as by the cooling control method or the quenching-tempering method. The ferromagnetic $\tau$ phase is the metastable phase which appears between the high temperature phase (close-packed hexagonal, lattice constant $a$ = 2.69A, $c$ = 4.38$A$; hereinafter referred to as the $\epsilon$ phase) and the room temperature phase (a phase in which the alloy is separated into the AlMn($\gamma$) phase and the $\beta$-Mn phase). This intermediate phase was discovered by Nagasaki, Kono, and Hirone in 1955. (Digest of the Tenth Annual Conference of the Physical Society of Japan, Vol. 3,162, October, 1955.)

However, the above Mn-Al alloys possess magnetic characteristics which are low, i.e., in the order of (BH) max = 0.5 × $10^6$ G.Oe,Br = 2200 G, and $_B$Hc = 600 Oe. Since then, a method has been developed of sintering the powdered alloy in the $\tau$ phase whereby the coercive force is increased by pulverizing; however, the magnetic characteristics of these alloys in isotropic form, at best, were low, being in the order of (BH) max = 0.6 × $10^6$ G.Oe, Br = 1700 G, and $_B$Hc = 1250 Oe. Moreover, since the products were formed from powder, their mechanical strengths were low, which makes these products impractical for commercial use.

On the other hand, a method has been proposed for improving the magnetic characteristics of these Mn-Al alloy magnets by applying a high degree of cold-working on the alloy in the $\tau$ phase (ferromagnetic phase) to render them anisotropic. It is known that rod shaped Mn-Al alloy magnets in the $\tau$ phase are sealed in nonmagnetic stainless steel pipes, and while being held in said pipes are subjected to cold-working, such as swagining, to a degree to 85~95%. This method is capable of producing an aniostopic permanent magnet possessing magnetic characteristics in the order of Br = 4280G, $_B$HC = 2700 Oe, and (BH) max ÷ 3.5 × $10^6$ G.Oe in the direction of preferred magnetization, i.e., the axial direction of the rod. Because Mn-Al alloy magnets are intermetallic compounds having very hard and brittle mechanical properties, however, even a cold-working of less than 1% causes cracks or fractures in the alloys.

On the other hand, since the degree of anisotropization is dependent upon the degree of cold-working, it is necessary to cold-work the alloy to a high degree, normally higher than 80%, in order to achieve satisfactory magnetic characteristics, and in order to be able to conduct such cold-working step, the cold-working operation must be conducted while the alloy is sealed in a nonmagnetic stainless steel pipe.

An anisotropic permanent magnet obtained by using the above method is complicated in that the Mn-Al alloy inside the pipe must be finely pulverized into powder, and, moreover, it is difficult to obtain rods of uniform cross-section. The method is therefor costly and of little practical value.

In order to overcome the above difficulties, a method has been proposed of obtaining a rod shaped anisotropic Mn-Al alloy magnet by subjecting the $\tau$ phase of the Mn-Al alloy magnet to hydrostatic extrusion at a temperature below 200° C, but the magnetic characteristics of such alloys is low, being in the order of (BH) max = 2.5~3.6 × $10^6$ G.Oe in the direction of preferred magnetization. This method also requires a very intricate hydrostatic extrusion operation and is again a very impractical method To replace the Mn-Al alloy magnets mentioned above, there have been invented manganese-aluminum-carbon alloy magnets in bulk shape having excellent magnetically isotropic characteristics, which magnets were disclosed in U.S. Pat. No. 3,661,567. Thus, according to U.S. Pat. No. 3,661,567, the Mn-Al-C alloy magnets may be obtained as isotropic permanent magnets in bulk shape excelling in magnetic characteristics, stability, weathering resistance and mechanical strength. These alloys may be multi-component alloys containing impurities or additives other than Mn, Al, and C, but should contain Mn, Al, and C as indispensable component elements, with the component ratio of Mn, Al, and C in these multi-component alloys falling within the following range:

Mn 69.5~73.0%
Al 26.4~29.5%
C 0.6~(⅓ Mn-22.2)% which alloys are manufactured under the restricted conditions described hereinunder:

Thus, Mn, Al and C are so mixed that each component falls within the respective composition range mentioned above, then the mixture is heated to a temperature higher than 1,380° C but lower than 1,500° C, in order to obtain a homogeneous melt with carbon forcibly dissolved therein, and thereafter the molten alloy is cast in a suitable mold. The ingot thus-obtained is heated above 900° C to form its high temperature phase, and then, is quenched by rapidly cooling it from a temperature above 900° C to a temperature below 600° C at a cooling rate of higher than 300° C/min. The quenched alloy is then tempered by heating it at a temperature of 480° C~650° C for an appropriate period of time. A Mn-Al-C alloy magnet in bulk shape obtained in this way has magnetic characteristics better than (BH) max = 1.0 × $10^6$ G.Oe, while in an isotropic state. This magnetic characteristic runs twice as high as the magnetic characteristics of isotropic Mn-Al alloy magnets.

The Mn-Al-C alloy magnets obtained in this way were isotropic in their bulk state, with the (BH) max running higher than 1.0 × $10^6$ G.Oe, and their mechanical strengths were as follows: hardness $H_{RC}$ = 45, tensile strength = 1~2 kg/mm$^2$, elongation = 0, compressive strength = 100 kg/mm$^2$, and transverse strength = 7 kg/mm$^2$.

The Mn-Al-C alloy magnets had serious disadvantages, however, in that in the course of trying to further improve their magnetic characteristics; by whichever method of the above mentioned cold working method or the powder forming method, the magnetic characteristics may be barely improved or rather degraded, and any improvement in their performance by way of anisotropization could not be anticipated.

SUMMARY OF THE INVENTION

This invention relates to Mn-Al-C alloy magnets which are superior to those disclosed in U.S. Patent No. 3,661,567.

Accordingly, it is an object of this invention to provide new high performance anisotropic permanent magnets having strikingly improved magnetic characteristics.

It is another object of this invention to provide anisotropic Mn-Al-C alloy magnets having magnetic characteristics such that the (BH) max is above $4.8 \times 10^6$ G.Oe and which reaches $9.2 \times 10^6$ G.Oe in the bulk state.

It is another object of this invention to provide very excellent anisotropic permanent magnets which exhibit a specific gravity as low as 5.1 and which have magnetic energies per unit weight comparable to those of the highest class of known permanent magnets, e.g., having energies per unit weight 2~3 times higher than those of anisotropic (Br,Sr) ferrite magnets, and 1.5~2 times as high as AlNiCo magnets.

It is a further object of this invention to provide anisotropic permanent magnets having excellent mechanical characteristics.

The present invention have found that in Mn-Al-c alloy magnets, which ordinarily exhibit no plasticity, there exists a new, special phase giving abnormally high plasticity in the specific temperature range of 530° C~830° C, in a compositional range wherein Mn is 68.0~73.0%, C(1/10 Mn-6.6)%~(1/3 Mn-22.2)% and wherein the remainder is Al. Based on these findings, the present inventors have successfully obtained Mn-Al-C alloy magnets which are anisotropic in their bulk state and which have extraordinary and unexpected magnetic characteristics, through plastic deformation of the alloy in the abnormally plastic range, while taking advantage of the specific state of existence of the carbon component.

The striking improvement in magnetic characteristics achieved by way of the above-described plastic deformation is a new phenomenon based on the peculiar mechanism which the Mn-Al-C alloy magnets possess. For example, in the case of Mn-Al alloy magnets, it was confirmed that the plasticity slightly appeared above 580° C, but that by the working above 530° C, no improvement in magnetic characteristics was recognized at all; rather, the magnetic characteristics were greatly degraded.

DESCRIPTION OF THE PREFERRED EMBODIMENT

Figure 1:
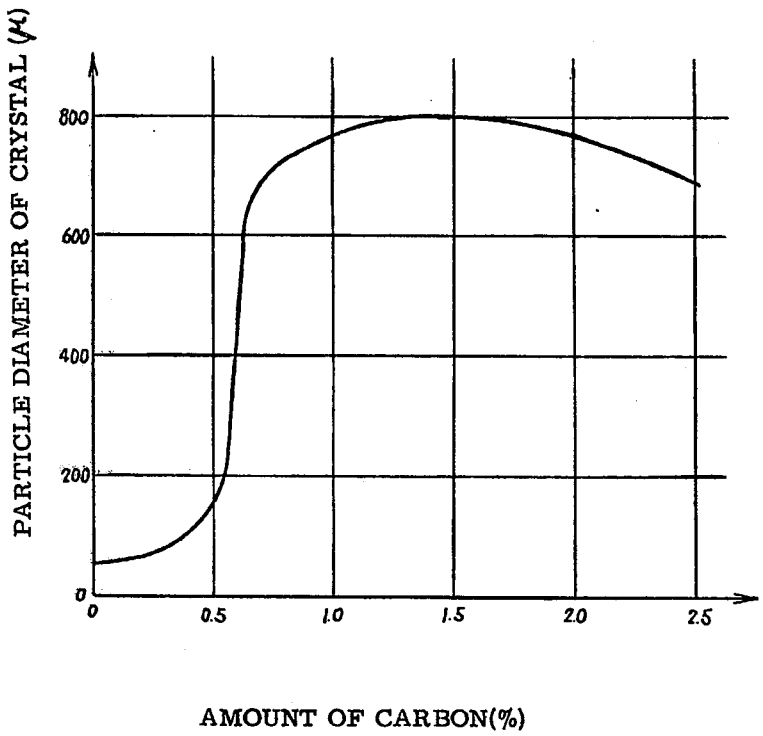
FIG. 1 presents a graph relating the particle diameter of the crystals and the amount of carbon in Mn-Al-C alloy castings consisting of 72.0% Mn, 0.1~2.5% C, and the remainder Al.

The present inventors have studied and analyzed the reasons why the magnetic characteristics of Mn-Al-C alloy magnets were improved especially when the manufacturing conditions were restricted in U.S. Pat. No. 3,661,567. As a result, it has been clarified that this improvement was due to the particular state of existence of carbon in the Mn-Al-C alloy magnets, i.e., the manufacturing conditions, and their magnetic characteristics have an intimate relationship. Accordingly, under manufacturing conditions which make the state of existence of carbon inadequate, magnets having low magnetic characteristics can be produced which are in the same order as isotropic Mn-Al alloy magnets, even if the composition ratio of Mn, Al and C falls within the above mentioned ranges, and even wherein sufficient $\tau$ phase exists.

It was discovered that in order to obtain isotropic permanent magnets from Mn-Al-C alloys having excellent magnetic characteristics, it is necessary that the phases existing in these alloys should mainly include:

1. a magnetic phase having carbon forcibly melted therein beyond the solubility limit, and
2. a phase of $Mn_3AlC$ and/or a face-centered cubic phase being similar to $Mn_3AlC$ in which the remaining excess carbon is separated out by way of tempering in the form of carbides other than aluminum carbide ($Al_4C_3$, etc.) in fine grainy or reticular shape, and that phase (2) is separated and dispersed finely in grainy or reticular form within phase (1) as its matrix. It has been proven that when alloys are produced according to the above-described phase conditions, magnets having greatly improved magnetic characteristics can be manufactured, which alloys possess a stabilized magnetic phase. This state of existence of carbon, as described above, was confirmed by way of X-ray diffraction techniques, optical microscopy and electron microscopy.

$Mn_3AlC$ is a compound having a face-centered cubic crystal structure of a perovskite type (lattic constant $a$ = 3.87A), but because its Curie point if 15° C, and it is nonmagnetic at room temperature, $Mn_3AlC$ itself, even when existing in the Mn-Al-C alloys does not contribute to the intensity of magnetization of the Mn-Al-C alloy magnets.

A face-centered cubic phase similar to $Mn_3AlC$ means that perovskite type carbides appear in the Mn-Al-C alloys containing an amount of carbon more than the solubility limit, or precipitation substance having the same chemical characteristics as that of said carbide but not formed carbide perfectly.

$Al_4C_3$ is a carbide existing in Mn-Al-C alloys containing Mn within the range of 68.0~73.0% and an amount of carbon in excess of (⅓ Mn – 22.2)%. It is formed at temperatures above the melting points of Mn-Al-C alloys, but is neither formed nor destroyed by heat treatment in the temperature range below the melting points. $Al_4C_3$ hydrolyzed by moisture in the air, etc., causes the alloys to crack, leading finally to the decay of alloys with the further proceeding of hydrolysis.

It has been clarified that in Mn-Al-C alloys, the solubility limit of carbon in the magnetic phase, as determined by the measurement of lattice constants by way of X-ray diffraction and by measurement of Curie point by use of a magnetic balance, is 0.6% for the composition of 72% Mn, 0.4% for the composition of 70% Mn, 0.2% for the composition of 68.0% Mn, and the solubility limit of carbon within the composition range of 68.0~73.0% Mn can be represented by the mathematical formula of (1/10 Mn–6.6)%.

On the other hand, the solubility limit of carbon in the high temperature phase is almost the same as the solubility limit of carbon in the magnetic phase at a temperature of 830° C, but in a temperature range of 900° C~1200° C, the solubility limit of carbon in this phase is more than (1/10 Mn–6.6)% of carbon; however, by overcooling by quenching at a temperature above 900° C, an $\epsilon$ phase can be obtained in which more than (1/10 Mn6.6)% of carbon is forcibly dissolved.

The high temperature phase into which carbon is forcibly dissolved in amounts beyond the solubility limit (1/10 Mn–6.6)% in Mn-Al-C alloys is designated the $\epsilon_c$ phase, to distinguish it from the $\epsilon$ phase of the high temperture phase containing carbon in amounts within the solubility limit. Also, the ferro-magnetic phase in which carbon is forcibly dissolved in amounts beyond the solubility limit is designated the $\tau_c$ phase, to distinguish it from the $\tau$ phase of the magnetic phase containing carbon in amounts within the solubility limit. By subjecting the alloys of this $\epsilon_c$ phase to the tempering as described above, the phase structure in which the phase of $Mn_3AlC$ and/or that of a face-centered cubic phase being similar thereto, is finely dipersed in grainy or recticular form in these alloys, with the $\tau_c$ phase forming the matrix. When, however, in the process of quenching, a gradual cooling is made at a cooling rate lower than 10° C/min. in the temperatre range of 830°~900° C, and then, the quenching is carried out from this temperature, or when the alloys are held in the temperature range of 830°~900° C, for more than 7 minutes, preferably more than 10 minutes, and quenching is from that temperature, $Mn_3AlC$ aligned in a lamellae parallel to the special crystal plane of $\epsilon_c$ (0001) and keeping intervals of 1–10$\mu$ is deposited in the $\epsilon_c$ phase. It has been clarified by way of optical microscopic observation and X-ray diffraction that this lamellar $Mn_3AlC$ has a crystalline orientation relationhip of $\epsilon_c$ (0001) / / $Mn_3AlC$ (111)

Furthermore, as the $\epsilon_c$ phase in the space of 1~10$\mu$, interposed between the lamellae of $Mn_3AlC$, was closely observed under an electron microscope, it was confirmed under the electron microscope, but not distinctively under the optical microscope, that the phase of $Mn_3AlC$ and/or face-centered cubic phase similar thereto were deposited on the plane of $\epsilon_c$ (0001), distanced from each other by 0.1~ 1$\mu$.

The heat treatment whereby the phase of $Mn_3AlC$ and/or face-centered cubic phase similar thereto was deposited in lamellae as described above, i.e., the heat treatment in which the alloys are cooled at a cooling rate lower than 10° C/min. in the temperture tange of 830°~900° C, or held in the temperature range of 830°~900° C for more than 7 minutes, is specifically designated the M treatment, and the $\epsilon_c$ phase containing the lamellar phase of $Mn_3AlC$ and/or face-centered cubic phase similar thereto deposited by the M treatment is abbreviated at the $\epsilon_c$ (M) phase.

By tempering the alloys of the $\epsilon_c$ (M) phase, the matrix $\epsilon_c$ transforms into the $\tau_c$ phase, but the lamellar phase of $Mn_3AlC$ and/or face-centered cubic phase similar thereto remains as it is, and then, the phase of $Mn_3AlC$ finely dispersed in grain form as mentioned above or in a recticular phase of $Mn_3AlC$ and/or face-centered cubic phase similar thereto is barely recognizable.

The $\tau_c$ phase containing the lamellar phase of $Mn_3AlC$ and/or face-centered cubic phase similar thereto is abbreviated as the $\tau_c$ (M) phase. The isotropic Mn-Al-C alloy magnet including the $\tau_c$ (M) phase as isotropic matrix has a low level of magnetic characteristics in the same order as the magnetic characteristics of isotropic Mn-Al alloys. The magnetic characteristics of Mn-Al-C alloy magnets is related to the existing condition of carbon, as mentioned above. Similarly, the magnetic characteristics and workability of anistropic Mn-Al-C alloy magnets rendered anisotropic by warm plastic deformation, according to this invention, are related to the existing condition of carbon.

Other and further objects, features and advantages of the invention will appear more fully from the following detailed description and Examples:

EXAMPLE 1

A monocrystal consisting of the $\epsilon_c$ phase of an Mn-Al-C alloy having a composition of Mn 72.28%, Al 26.64% and C 1.08%, as chemically analyzed, was manufactured.

As a result of studies on the various factors involved in obtaining the $\epsilon_c$ monocrystal of this Mn-Al-C alloy, it was clarified that the growth of crystal necessary for monocrystallization is dependent on amounts of carbon.

It is, thus, an indispensable condition for obtaining the $\epsilon_c$ monocrystal that the amount of carbon falls within the range of (1/10 Mn–6.6)% ~ (⅓ Mn–22.2)% (provided that, Mn 68.0 ~ 73.0%), and that the process of heating above 1,380° C, and up to 1,500° C (the required melting temperature to forcibly melt carbon into its solid solution) be run at least for one cycle. It was found out, for example, that whereas in the $\epsilon$ phase in which the amount of carbon in its solid solution was less than (1/10 Mn–6.6) %, the growth of crystals in the alloy took place with difficulty. However, in Mn-Al-C alloys in which carbon in an amount in excess of the solubility limit of (1/10 Mn–6.6)% was forcibly melted well into its solid solution at a melting temperature of above 1,380° C, the coarsing of the crystal grains was notable. Accordingly, the $\epsilon_c$ monocrystal may be easily obtained by way of cooling the molten metal of this alloy from one end thereof by the Bridgman method or the chill mold method.

With regard to the growth of crystals of the $\epsilon_c$ phase, for examply, in the case of polycrystals formed under the ordinary casting condition, as shown in FIG. 1, containing carbon in amounts above the solubility limit, the coarsening of the crystal grains becomes notable, and the grain size of crystals increases with the increasing amount of forcibly dissolved carbon; but as the amount of carbon exceeds (⅓ Mn–22.2)%, the excess carbon forms aluminum carbide $Al_4C_3$, which is undesirable. For these reasons, the required amounts of carbon to obtain $\epsilon_c$ monocrystals are limited within the range of (1/10 Mn–6.6)% ~ (⅓ Mn–22.2)% as mentioned above.

In order to forcibly melt the carbon well into solid solution, it must be heated to a temperature of higher than 1,380° C. At melting temperatures lower than 1,380° C, it is not possible to forcibly dissolve carbon into its solid solution in amounts beyond the solubility limit.

Accordingly, in the case of obtaining the $\epsilon_c$ monocrystals, the respective component elements were mixed and alloyed by heating them above 1,380° C, and then, monocrystalized. On the other hand, a Mn-Al-C alloy in which carbon was preliminarily dissolved into its solid solution at a temperature above 1,380° C, was remelted and monocrystallized. In the latter instance, the heating temperature for the $\epsilon_c$ monocrystallization was not necessarily required to be above 1,380° C, since heating at a temperature above its melting point of 1,210° ~ 1,250° C was sufficient.

The temperature control conditions for obtaining the $\epsilon_c$ monocrystal by cooling the molten metal of the Mn-Al-C alloy from one end were chosen as follows:

The molten metal was solidified at a falling rate of 0.5 ~ 10 cm/hr under a temperature gradient of 5° ~ 200° C/cm in a temperature range of 1,150° ~ 1,250° C, or solidified from one end at a cooling rate of 10° ~ 100° C/hr in the aforementioned temperature range, and the monocrystal, was then, cooled to 900° C, and thereafter, quenched from a temperature of 900° C to a temperature below 500° C by cooling it in the temperature range of 900° ~ 500° C at a cooling rate of 300° ~ 3,000° C/min. In this way, a $\epsilon_c$ monocrystal in the shape of a cylinder of 35 mm outside diameter could be easily obtained.

From the $\epsilon_c$ monocrystal obtained in this way, a cubic test piece of 8 × 8 × 8 mm having surfaces of (0001), $(1\bar{1}00)$ and $(11\bar{2}0)$ was cut out. This $\epsilon_c$ monocrystal was tempered at 600° C was 1 hour. The tempered test piece was found to be magnetically isotropic, as its magnetic characteristics were measured. The magnetic characteristics found were:

Br = 2,750 G, $_BHC$ = 1,350 Oe, and (BH) max = 1.1 × $10^6$ G.Oe, which were equivalent to the magnetic characteristics of isotropic Mn-Al-C alloy magnets of the ordinary polycrystal type. By optical microscope observation of the structure of the test piece after being tempered, a finely dispersed grainy or reticular deposition of the $Mn_3AlC$ phase was observed, just as in the structure of the ordinary isotropic magnet. From the result of the X-ray diffraction, however, it was confirmed that since the intensity of diffracted lines from the $Mn_3AlC$ phase differed, depending on the diffracting surfaces of the test piece, a small amount of the $Mn_3AlC$ phase oriented in its relationship to the $\epsilon_c$ phase before being tempered as expressed by $\epsilon_c$ (0001) // $Mn_3AlC$ (111) existed.

Furthermore, other test pieces subjected to similar experiments as described above, with other surfaces cut out and the tempering conditions altered, were all found to be isotropic magnets, in which no improvements in their magnetic characteristics were recognized.

EXAMPLE 2

An $\epsilon_c$ monocrystal obtained in Example 1, was subjected to the M treatment in which it was held at a temperature of 830° C for 20 minutes, and was then quenched from this temperature at a cooling rate of 300° ~ 3,000° C/min. The monocrystal thus obtained had the phase (expressed $\epsilon_c$(M) monocrystal) in which the $Mn_3AlC$ phase was orderly deposited in the shape of lamellae on the (0001) plane of the $\epsilon_c$ monocrystal, as described hereinbefore. The orientation relationship was found to be:

$$\epsilon_c\ (0001)\ //\ Mn_3AlC\ (111)$$

as described above, which was confirmed by way of X-ray diffraction, X-ray microanalysis, optical microscopy and chemical analysis.

Figure 2:
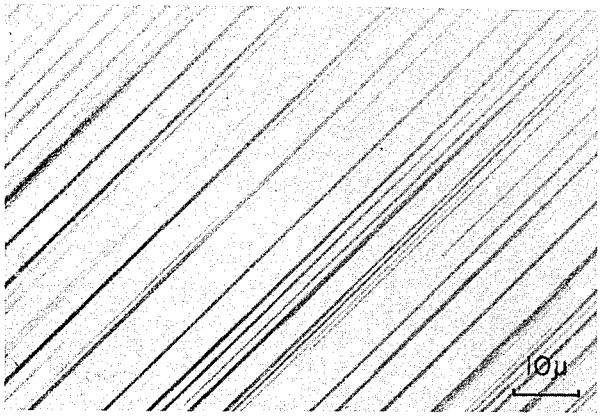
FIG. 2 represents a photograph of an optical microstructure of the $\epsilon_c$(M) phase.

FIG. 2 presents a photograph of optical microstructure (magnification: 1,000) showing a state in which the $Mn_3AlC$ phase is deposited in the shape of lamellae in the matrix of $\epsilon_c$.

After deciding the crystal orientation by utilizing the lamellar structure and X-ray diffraction, from the $\epsilon_c$ (M) monocrystal obtained as described above, a cubic test piece of 8 × 8 × 8 mm having surfaces of (0001), $(1\bar{1}00)$ and $(11\bar{2}0)$ was cut out, and was subjected to a tempering at 570° C for 1 hour to obtain the $\tau_c$ (M) phase. It was recognized by way of optical microscopic observation and X-ray diffraction that the $\epsilon_c$ phase of the matrix was transformed into the $\tau_c$ phase by this tempering, but the lamellar structure was not destroyed.

The magnetic characteristics of the test piece of the $\tau_c$ (M) phase were quite isotropic. They were found to be: Br = 2,550 G, $_BHc$ = 800 Oe, and (BH) max = 0.67 × $10^6$ G.Oe, which were lower than the magnetic characteristics of the ordinary isotropic Mn-Al-C alloy magnets of the polycrystal type. Other test pieces observed, with the face cut out and the treating condition widely altered, were all found to be isotropic, and no improvement in magnetic characteristics was recognized in these test pieces.

EXAMPLE 3

A monocrystal in the $\epsilon_c$ (M) phase of an Mn-Al-C alloy containing 72.10% Mn, 26.78% Al and 1.12% C, as chemically analyzed, was manufactured in the manner similar to that of Example 2, and from this monocrystal in the $\epsilon_c$ (M) phase, several cubic test pieces were cut out, each of 10 × 10 × 10 mm having 3 surfaces respectively being parallel to the 3 crystal planes of $(3\bar{3}04)$, $(11\bar{2}0)$ and $(3\bar{3}08)$. When one of the test pieces was subjected to pressure at a temperature of 550° C and at a pressure of 30 kg/mm² in the direction perpendicular to the $(3\bar{3}04)$ plane, using an oil-hydraulic press machine to deform it plastically to the $\epsilon_c$ (M) phase, it was found that a rapid shrinkage in the pressuring direction took place within several minutes (B point) after the pressuring was begun (A point), leading to a rapid and notable plastic deformation. (See the deformation curve of FIG. 3.) This rapid shrinkage in the pressuring direction reached a saturation (C point) at a degree of shrinkage of 15%, as expressed by the ratio of the length of the test piece before and the length of the test piece after pressuring, and barely underwent a change (D point), even though the pressuring time was extended beyond that point. The magnetic characteristics of this test piece after being subjected to a warm deforming operation were measured to be low, but by subjecting this test piece to tempering at a temperature of 570° C, an anisotropic magnet having very excellent magnetic characteristics oriented in one direction with its preferred direction of magnetization at about right angles to the pressuring direction was obtained.

For the purpose of making detailed studies of the phenomenon that a rapid and notable plastic deformation is induced by warm deformation of the $\epsilon_c$ (M) phase and of the phenomenon that, by tempering after this deformation, anisotropic magnets oriented in one direction are obtained, similar experiments as that above described were pursued, with the degree of deformation diversified as described below, to examine the phase of the test piece in deformation process.

First, the test piece deformed by pressuring to B point just before the rapid plastic deformation begins is designated as $S_1$, the test piece deformed by pressuring to E point intermediary between B point and C point as $S_2$, the test piece deformed by pressuring just before C point where the rapid plastic deformation ends as $S_3$, and the test piece deformed by pressuring to D point mentioned above as $S_4$, respectively. The degrees of deformation in these test pieces were found to be: $S_1$ — 1.9%, $S_2$ — 7.3%, $S_3$ — 14.6% and $S_4$ — 15.0%. With regard to the shape of the test pieces after being subjected to this warm deformation, the degrees of elongation were different in the directions of measurement in every test piece, particularly, in the test pieces of $S_3$ and $S_4$, elongations in the direction corresponding to the direction perpendicular to $(3\bar{3}0\bar{8})$ before their pressuring were notable, but only small elongations were recognized in the direction corresponding to the direction perpendicular to $(11\bar{2}0)$ before their pressuring.

As the phase of these 4 test pieces after being deformed was examined by way of X-ray diffraction, with the test pieces of $S_1$, $S_2$ and $S_3$, a quite new diffraction pattern which has never been observed before from either the Mn-Al alloys or the Mn-Al-C alloys was found. This quite new diffraction pattern, as a result of its analysis, was found to be due to the existence of a new phase of orthorhombic structure with lattice constants of $a = 4.371$A, $b = 2.758$A and $c = 4.582$A, which crystal structure belongs to B19 type (MgCd type) in terms of the Struktur-Bericht type expression, thus making evident the existence of quite a new phase differing from the usual phases $\epsilon$, $\epsilon_c$, $\tau$, $\tau_c$, or such carbides as $Mn_3AlC$. It was also clarified that this orthorhombic crystal phase is an order phase which makes its appearance at the intermediary stage in the $\epsilon_c \rightarrow \tau_c$ transformation process, and the $\epsilon \rightarrow \epsilon'_c$ transformation is an order-disorder transformation, where $\epsilon'_c$ designates the order phase of this orthorhombic crystal.

In Table 1, the results of the X-ray diffraction of the $\epsilon'_c$ phase by the powder method are shown. With the test piece of $S_1$, only the diffracted lines from the aforementioned new $\epsilon'_c$ phase were found, except for the diffracted lines due to the lamellar $Mn_3AlC$ phase, and moreover, it became apparent that the $\epsilon'_c$ phase is a crystal oriented in one direction, and that between the $\epsilon_c$ phase of the matrix before the pressuring and the $\epsilon'_c$ phase of the matrix after the pressuring, there exists crystal orientation relationships of $\epsilon_c$ (0001) //$\epsilon'_c$ (100), $\epsilon_c$ [0001] // $\epsilon'_c$ [100]

Table 1

| Observed values | | | Calculated values | |
|---|---|---|---|---|
| Interfacial distance (A) | Relative intensity | Miller indices | Interfacial distance (A) | Relative intensity |
| 4.587 | 5 | 001 | 4.582 | 7.4 |

Table 1-continued

| Observed values | | | Calculated values | |
|---|---|---|---|---|
| Interfacial distance (A) | Relative intensity | Miller indices | Interfacial distance (A) | Relative intensity |
| 3.162 | 8 | 101 | 3.163 | 17.3 |
| 2.764 | 3 | 010 | 2.758 | 7.0 |
| 2.363 | 14 | 011 | 2.363 | 24.9 |
| 2.292 | 16 | 002 | 2.291 | 12.4 |
| 2.186 | 44 | 200 | 2.186 | 41.0 |
| 2.077 | 100 | 111 | 2.079 | 100.0 |
| 2.033 | 38 | 102 | 2.029 | 49.9 |
| | | 201 | 1.973 | 1.3 |
| | | 012 | 1.762 | 0.8 |
| 1.712 | 3 | 210 | 1.713 | 11.4 |
| | | 112 | 1.643 | 3.8 |
| 1.606 | 13 | 211 | 1.604 | 14.1 |
| 1.586 | 6 | 202 | 1.581 | 7.1 |
| | | 003 | 1.527 | 1.0 |
| | | 301 | 1.388 | 1.1 |
| 1.381 | 6 | 020 | 1.379 | 8.7 |
| | | 212 | 1.372 | 0.7 |
| 1.338 | 11 | 013 | 1.336 | 17.3 |
| | | 021 | 1.320 | 0.3 |
| | | 121 | 1.264 | 1.6 |
| | | 203 | 1.252 | 1.2 |
| 1.240 | 16 | 311 | 1.240 | 22.9 |
| 1.228 | 6 | 302 | 1.229 | 11.4 |
| | | 022 | 1.181 | 3.7 |
| 1.167 | 16 | 220 | 1.166 | 15.1 |
| | | 004 | 1.146 | 1.9 |
| 1.1411 | 241 | 122 | 1.141 | 23.2 |
| | | 213 | 1.140 | 30.2 |

With the test piece of $S_2$, the diffracted lines from the $\epsilon'_c$ phase and the diffracted lines from the $\tau_c$ phase existed, besides the diffracted lines from the lamellar $Mn_3AlC$ phase, and moreover, the $\epsilon'_c$ phase and the $\tau_c$ phase were both oriented to one direction. With the test piece of $S_3$, the diffracted lines from a small amount of $\epsilon'_c$ phase and a large amount of $\tau_c$ phase existed, besides the diffracted lines from the lamellar $Mn_3AlC$ phase, and moreover, the $\epsilon'_c$ phase and $\tau_c$ phase were both unidirectionally oriented as in the case of $S_2$. Between the unidirectionally oriented $\epsilon'_c$ phase and $\tau_c$ phase, there existed such a specific crystal orientation relationship as:

$$\epsilon'_c\,(100) \,//\, \tau_c\,(111).$$

With the test piece of $S_4$, only the diffracted lines from the $\tau_c$ phase were found, other than the diffracted lines from the lamellar $Mn_3AlC$ phase, and moreover, the $\tau_c$ phase was found nearly unidirectionally oriented.

The angle of the diffracted lines from the $\tau_c$ phase in the test pieces of $S_2$, $S_3$ and $S_4$ were a little deviated from the angles of the diffracted lines from the ordinary $\tau_c$ phase in the isotropic Mn-Al-C alloy magnets, and thus, some difference in lattice constants was observed.

As these test pieces after being deformed were subjected to a tempering (tempering temperature 580° C) without pressing, the magnetic characteristics of the test pieces after being tempered improved with the increasing tempering time; very excellent anisotropic magnets having respectively their magnetic characteristics shown in Table 2 were obtained in the tempering time of 18 hours with $S_1$, 24 hours with $S_2$, 30 hours with $S_3$ and 15 hours with $S_4$.

It is to note that the right angle direction (1) in Table 2 denotes the measuring direction at a right angle to the pressuring direction and corresponding to the direction perpendicular to the $(11\bar{2}0)$ plane before the pressuring, and the right angle direction (2) the measuring direction at a right angle to the pressuring direction but corresponding to the direction perpendicular to the $(3\bar{3}08)$ plane before the pressuring.

Table 2

| Name of test piece | Measuring direction | After the deforming Br (G) | After the deforming $B^{//c}$ (Oe) | After the deforming BHmax ($\times 10^6$G.Oe) | After the tempering Br (G) | After the tempering $B^{//c}$ (Oe) | After the tempering BHmax ($\times 10^6$G.Oe) |
|---|---|---|---|---|---|---|---|
| | Pressuring direction | | | | 1,100 | 450 | 0.3 |
| $S_1$ | Right angle direction (1) | Nonmagnetic | | | ≈ 0 | ≈ 0 | ≈0 |
| | Right angle direction (2) | | | | 6,650 | 1,950 | 6.5 |
| | Pressuring direction | ≈ 0 | ≈ 0 | ≈ 0 | 750 | 300 | 0.1 |
| $S_2$ | Right angle direction (1) | ≈ 0 | ≈ 0 | ≈ 0 | ≈ 0 | ≈ 0 | ≈0 |
| | Right angle direction (2) | 200 | 100 | <0.1 | 6,850 | 2,150 | 7.2 |
| | Pressuring direction | ≈ 0 | ≈ 0 | ≈ 0 | ≈ 0 | ≈ 0 | ≈0 |
| $S_3$ | Right angle direction (1) | ≈ 0 | ≈ 0 | ≈ 0 | ≈ 0 | ≈ 0 | ≈0 |
| | Right angle direction (2) | 550 | 200 | 0.1 | 6,900 | 2,300 | 9.1 |
| | Pressuring direction | 950 | 500 | 0.2 | 1,400 | 600 | 0.3 |
| $S_4$ | Right angle direction (1) | 200 | 100 | <0.1 | 500 | 200 | <0.1 |
| | Right angle direction (2) | 4,300 | 1,650 | 1.3 | 6,700 | 2,250 | 6.8 |

Of these test pieces, that of $S_3$ after being tempered was found, as a result of observation by X-ray diffraction, to be a $\tau_c$(M) monocrystal with its C axis, the easy axis of magnetization of the $\tau_c$ phase of the matrix, oriented in the direction making an angle of about 82° to the pressuring direction. As this test piece was cut out, and its magnetic characteristics in the easy direction of magnetization (C axis direction) were measured, they were found to be very excellent:

| | | |
|---|---|---|
| Br = ~7,000 G | $_BHC$ = 2,300 Oe | BHmax = 9.2 × $10^4$ G.Oe |
| $4\pi I_{10000}$ = 7,100 G | $_iHC$ = 2,350 Oe | $Br/4\pi I_{10000}$ = 0.98 |

When a disc test piece containing the easy direction of magnetization in the direction parallel to the disc surface was cut out of this monocrystal test piece, and its magnetic torque was measured, its value (it corresponds to an anisotropy constant) was found to be 1.07 × $10^7$ dyne-cm/cm$^3$. Furthermore, the magnetic torque was measured likewise of the test pieces of $S_1$, $S_2$ and $S_4$ after being tempered. The values were respectively, 0.93 × $10^7$ dyne-cm/cm$^3$, 0.97 × $10^7$ dyne-cm/cm$^3$ and 0.95 × $10^7$ dyne-cm/cm$^3$, and as the degree of anisotropization was expressed by their ratio to the value of magnetic torque of monocrystal, i.e., the 1.07 × $10^7$ dyne-cm/cm$^3$ above mentioned, all of these test pieces had such very high degrees of anisotropization, e.g. more than 0.9.

The crytsal direction of the $\tau_c$ phase after being tempered was the same as the crystal direction of the $\tau_c$ phase before being tempered, and the change in the crystal direction of the $\tau_c$ phase due to the tempering was barely recognized.

Furthermore, as a result of making detailed studies of the phenomenon of rapid plastic deformation in the warm deforming of the $\epsilon_c$(M) phase above described and of the process of forming the unidirectionally oriented anisotropic magnets, it became evident that these phenomena are based on the $\epsilon_c \rightarrow \epsilon'_c \rightarrow \tau_c$ transformation made in specific crystal orientation relationships.

Thus, when a monocrystal in the $\epsilon_c$(M) phase is pressured in the direction above mentioned, the matrix turns into a monocrystal in $\epsilon'_c$ having the crystal orientation relationships of $\epsilon_c$ (0001) // $\epsilon'_c$ (100)
$\epsilon_c$ [0001] // $\epsilon'_c$ [100]

through an order-disorder transformation of $\epsilon_c \rightarrow \epsilon'_c$. This $\epsilon_c \rightarrow \epsilon'_c$ transformation corresponds to the process followed from A point to B point in FIG. 3, and the shrinkage in the pressuring direction is not excessively large.

Furthermore, the $\epsilon'_c$ monocrystal transforms into a $\tau_c$ monocrystal having the relationship of $\epsilon'_c$ (100) // $\tau_c$ (111) through the $\epsilon'_c \rightarrow \tau_c$ martensitic transformation in which the specific (100) plane slides to the direction of [001] at a specific distance.

The sliding of the plane to the specific direction rapidly takes place in avalance-like manner, and induces a rapid shrinkage in the pressuring direction from point B to point C. Then, at the point of time when the sliding of all of the plane in the monocrystal has finished, that is to say, all parts of $\epsilon'_c$ transformed into $\tau_c$, i.e., at point C, the shrinkage in the pressuring direction stops. After all parts of $\epsilon'_c$ had been transformed into $\tau_c$, little deformation occurred, even when the pressuring was continued.

Figure 4:
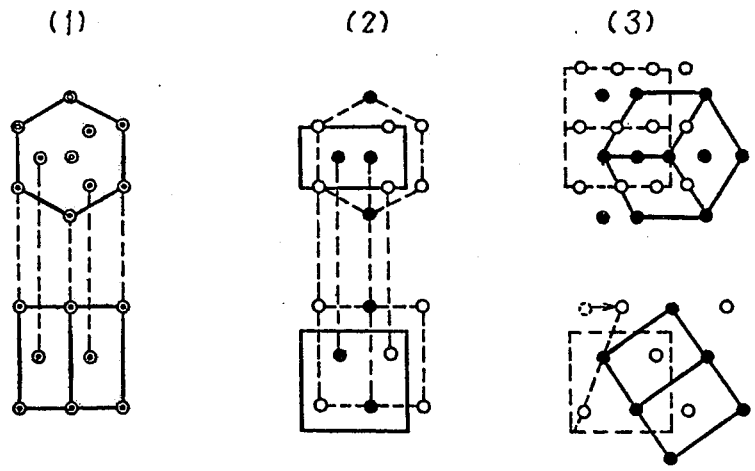
FIG. 4 exhibits diagrams showing the process of change in the crystal structure undergoing the transformation: $\epsilon_c \rightarrow \epsilon_c' \rightarrow \tau_c$.

FIG. 4 presents diagrams showing the changing process of the crystal structure in the $\epsilon_c \rightarrow \epsilon'_c \rightarrow \tau_c$ transformation described above. FIG. 4-(1) represents a diagram showing the crystal structure of the phase of $\epsilon_c$, (2) that of $\epsilon'_c$, and (3) that of $\tau_c$. The diagram of (1) portrays a view of the $\epsilon_c$ phase taken from the directions perpendicular respectively to its (0001) plane and $(11\bar{2}0)$ plane; (2), that of $\epsilon'_c$ seen perpendicular to its (100) plane and (010) plane; and (3) that of seen perpendicular $\tau_c$ to its (111) plane and $(1\bar{1}0)$ plane. The solid lines designate respective crystal lattices; the dotted lines, the locational relationship of atoms; and the arrows, the moving direction of the plane of atoms. The double circles ◎ indicate the positions of atoms of Mn or Al in the disorder structure; the blank circle ○ and the solid circle ● respectively show the positions of atoms of Al and Mn in the order structure. The positions of atoms of carbon being in the state of solid solution were omitted.

The $\tau_c$ after being deformed has very low magnetic characteristics, but it turns into an anisotropic magnet having very excellent magnetic characteristics when tempered.

Figure 5:
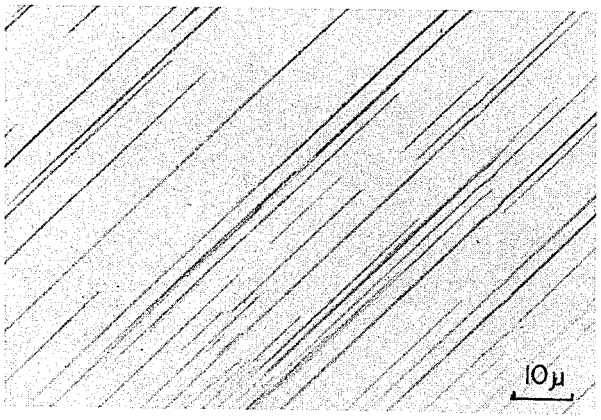
FIG. 5 displays a photograph of an optical microstructure of the $\tau_c$(M) phase.

It became apparent that based on such a mechanism, the phenomenon of rapid plastic deformation takes place, and the unidirectionally oriented anisotropic magnet is formed. Accordingly, the optical microstructure of the test piece after being subjected to the warm deforming was found to be quite uniform and smooth, although the existence of the lamellar $Mn_3AlC$ phase was observed, as shown by the structure photograph at a multiplicity of 1,000 in FIG. 5, and the fragmented or broken structure of crystal due to slip lines or twin structure which were observed in the structure of ordinary alloys after being deformed were not observed.

It became evident that the rapid plastic deformation in the warm deformation of the $\epsilon_c(M)$ phase is not the deformation due to slip or twin which is observed in the ordinary plastic deforming of other metals or alloys, but the deformation based on the $\epsilon'_c \rightarrow \tau_c$ martensitic transformation. Accordingly, the saturation of this deformation is based on a mechanism entirely different from that of the saturation of the ordinary deformation due to the hardening by the working of metals or alloys. Furthermore, it was made clear that the anisotropy of elongation in the test piece after being worked mentioned above is due to the sliding of the specific plane to a specific direction in the $\epsilon'_c \rightarrow \tau_c$ transformation.

In the test piece of $S_1$ and $S_2$, shrinkages in the direction of former pressuring were recognized after making the tempering, and $S_1$ was found to have shrunk by 5.5%, and $S_2$ by 6.0% aftermaking the tempering as compared to before making the tempering. A likely interpretation of this phenomenon is: from $\epsilon'_c$ crystal which is formed by transforming under pressure, directionally oriented $\tau_c$ crystal seems to have been formed even by the $\epsilon'_c \rightarrow \tau_c$ transformation without pressure. In order to obtain unidirectionally oriented magnets having the most excellent magnetic characteristics, however, it is essential to proceed with the warm deforming just before reaching the saturation deformation, i.e., just before C point in FIG. 3.

EXAMPLE 4

An experiment of plastic warm deforming similar to that of Example 3 was performed by changing the pressuring direction, pressuring temperature and pressuring force.

A monocrystal in the $\epsilon_c(M)$ phase of an Mn-Al-C alloy having the composition of Mn 71.93%, Al 27.02% and C 1.05%, as chemically analyzed, was manufactured by the similar method as that of Example 2, and from this monocrystal in the $\epsilon_c(M)$ phase, a cubic or rectangular monocrystal test piece to be pressured having sides of 5~12 mm were cut out. The test piece to be pressured were so cut out as to have 3 faces (a), (b) and (c) making a right angle to each other:

a. a face perpendicular to the pressuring direction, b. a face parallel to the crystal face containing the pressuring direction and the $\epsilon_c$ [0001] direction, and c. a face making right angles to (a) and (b).

The cut out test pieces were deformed by applying a pressure of 10–40 kg/mm$^2$ on a oil hydraulic press at a temperature range of 500~850° C, and were then, further subjected to a tempering in the temperature range of 550°~650° C. The preferred direction of magnetization of the test pieces after being tempered was determined by way of X-ray diffraction or measurement of magnetic torque or measurement of the magnetization curves in varied directions, and its magnetic characteristics in the preferred direction of magnetization were measured.

Table 3 shows the conditions of warm deformation (pressuring direction, pressuring temperature, degree of deformation in the pressuring direction) of each test piece and the values of its magnetic characteristics in the preferred direction of magnetization after tempering. The pressuring direction was further distinguished by expressing it by the angles of $\theta_1$ and $\theta_2$, assuming the angle made by the pressuring direction and the $\epsilon_c$[0001] direction as $\theta_1$ and the angle made by the projected axis of the pressuring direction on the $\epsilon_c(0001)$ face and the $\epsilon_c[1\bar{1}00]$ as $\theta_2$. For example, the pressuring direction of $\theta_1 = 90°$, $\theta_2 = 0°$ is perpendicular to the $\epsilon_c(1\bar{1}00)$ plane and the pressuring direction perpendicular to the $(3\bar{3}04)$ plane of Example 3 is expressed approximately by $\theta_1 = 55°$, $\theta_2 = 0°$.

Table 3

| Designation of test piece | Pressuring direction $\theta_1$ | $\theta_2$ | Temperature (° C) | Degree of deformation (%) | Br (G) | $_{B}$Hc (Oe) | BHmax (×10$^6$G.Oe) |
|---|---|---|---|---|---|---|---|
| $S_5$ | 0° | 0° | 600 | − 0.8 | 3,300 | 1,400 | 1.3 |
| $S_6$ | 20° | 0° | 550 | − 2.6 | 4,750 | 1,550 | 3.3 |
| $S_7$ | 35° | 0° | 550 | −12.0 | 6,500 | 2,050 | 7.2 |
| $S_8$ | 55° | 0° | 500 | − 0.2 | 2,900 | 1,500 | 1.6 |
| $S_9$ | 55° | 0° | 530 | −14.8 | 6,900 | 2,250 | 9.0 |
| $S_{10}$ | 55° | 0° | 720 | −14.5 | 6,800 | 2,200 | 8.1 |
| $S_{11}$ | 55° | 0° | 850 | −14.0 | 2,600 | 1,600 | 1.4 |
| $S_{12}$ | 55° | 0° | 650 | − 0.4 | 2,950 | 1,400 | 1.1 |
| $S_{13}$ | 55° | 0° | 600 | −25.0 | 3,100 | 1,800 | 2.0 |
| $S_{14}$ | 70° | 0° | 580 | −12.0 | 6,600 | 2,000 | 7.3 |
| $S_{15}$ | 90° | 0° | 530 | − 2.0 | 6,250 | 2,300 | 7.6 |
| $S_{16}$ | 90° | 0° | 560 | − 3.2 | 6,100 | 2,150 | 7.0 |
| $S_{17}$ | 35° | 10° | 830 | −12.9 | 6.400 | 2,100 | 7.0 |
| $S_{18}$ | 35° | 15° | 550 | −11.7 | 6,350 | 2,050 | 6.6 |
| $S_{19}$ | 70° | 15° | 600 | −10.0 | 6,400 | 1,750 | 6.2 |
| $S_{20}$ | 55° | 20° | 650 | − 6.2 | 4,150 | 1,500 | 2.3 |
| $S_{21}$ | 50° | 30° | 580 | − 4.4 | 3,700 | 1,350 | 2.2 |
| $S_{22}$ | 90° | 30° | 560 | − 0.5 | 3,300 | 1,300 | 1.7 |

Considering the symmetry of the hexagonal crystal, $\theta_1$ and $\theta_2$ were assumed to fall within the angle ranges of $0° \leq \theta_1 \leq 90°$, $0° \leq \theta_2 \leq 30°$. All pressuring directions falling outside these angle ranges can be replaced in terms of the pressuring directions falling within the aforementioned angle ranges, on the basis of the symmetry of the hexagonal crystal.

The results of the experiments conducted by altering the pressuring direction were that most of the pressuring directions were effective in producing anisotropic magnets, but large differences wre recognized in the values of the magnetic characteristics, depending on the pressuring direction. Especially when the pressuring direction fell within the angle ranges of $35° \leq \theta_1 \leq 90°$, $0° \leq \theta_2 \leq 15°$, anisotropic magnets having very excellent magnetic characteristics with (BH)max in their preferred direction of magnetization above $6 \times 10^6$ G.Oe were obtained. On the other hand, in the cases of the pressuring directions being $\theta_1 = 0°$, $\theta_2 = 0°$, and $\theta_1 = 90°$, $\theta_2 = 30°$, the magnets obtained were nearly isotropic, allowing only some predominance in magnetic characteristics in the direction at a right angle to the pressuring direction. The preferred direction of magnetization where the maximum values of magnetic characteristics appear varies, depending on the pressuring direction used. For example, when $\theta_1 = 55°$, $\theta_2 = 0°$, the test piece $S_9$ showed such a direction making an angle of about 82° to the pressuring direction, and when $\theta_1 = 70°$, $\theta_2 = 0°$, the test piece $S_{14}$ showed a direction making about 70° to the pressuring direction. All of them obtained were in the $\tau_c$(M) phase unidirectionally oriented in which the $\tau_c$[001] axis was abounding in the preferred direction of magnetization. In the test piece $S_{15}$, and when $\theta_1 = 90°$, $\theta_2 = 0°$, the preferred direction of magnetization lay in the pressuring direction, but the $\tau_c$[001] axis did not lie in the pressuring direction. But the $\tau_c$ [001] axis was found in two directions making an angle of about 37° to the pressuring direction as the center of symmetry.

The magnetic characteristics of the $\tau_c$(M) crystals which are formed from the $\epsilon_c$(M) monocrystals by warm deformation and tempering depend on the degree of orientation of the $\tau_c$(M) crystals. The orientation of the $\tau_c$(M) crystals relates closely to the directon of pressure. And also, the orientation relates to the orientation of the $\epsilon'_c$(M) phase before being transformed: thus when the pressuring direction falls within the angle ranges of $35° \leq \theta_1 \leq 90°$, $0° \leq \theta_2 \leq 15°$, the $\epsilon'_c$ phase of the matrix formed by the $\epsilon_c \rightarrow \epsilon'_c$ transformation is nearly unidirectionally oriented, and then, the one-directional or two-directional $\tau_c$ phase was formed by the ensuing $\epsilon'_c \rightarrow \tau_c$ transformation. On the other hand, it was made clear by the X-ray diffraction that when the pressuring directions are $\theta_1 = 0°$, $\theta_2 = 0°$, and $\theta_1 = 90°$, $\theta_2 = 30°$ multi-directional $\epsilon'_c$(M) phase is formed, with resultant formation of the multi-directional $\tau_c$(M) phase.

Accordingly, it was confirmed that it is essential to form a nearly uni-directional $\epsilon'_c$ (M) phase, in order to obtain anisotropic magnets having magnetic characteristics of (BH) max above $6.0 \times 10^6$ G.Oe.

When varying pressuring temperatures were used, in case of pressuring directions falling within the angle ranges of $35° \leq \theta_1 \leq 90°$, $0° \leq \theta_2 \leq 15°$ were used, within the temperature range of 530°~830°, anisotropic magnets having excellent mgnetic characteristics of (BH)max above $6 \times 10^6$ G.Oe were obtained, but below the temperature of 500° C, anisotropization did not occur with almost negligible plasticity, and above the temperature of 850° C, the magnetic characteristics were nearly isotropic, with lessened plasticity. Besides, deformation velocity increases with a rising temperature up to 750° C.

As the relationship between the degree of deformation and the magnetic characteristics was examined, the magnetic characteristics was examined, the magnetic characteristics of the test pieces remained low, when the test pieces pressured in directions falling with the angle ranges of $35° \leq \theta_1 \leq 90°$, $0° \leq \theta_1 \leq 15°$ shrunk beyond the degree of saturation deformation described later, as previously described in Example 3, or when the degree of deformation did not reach to one-tenth of the degree of saturation deformation.

Figure 6:
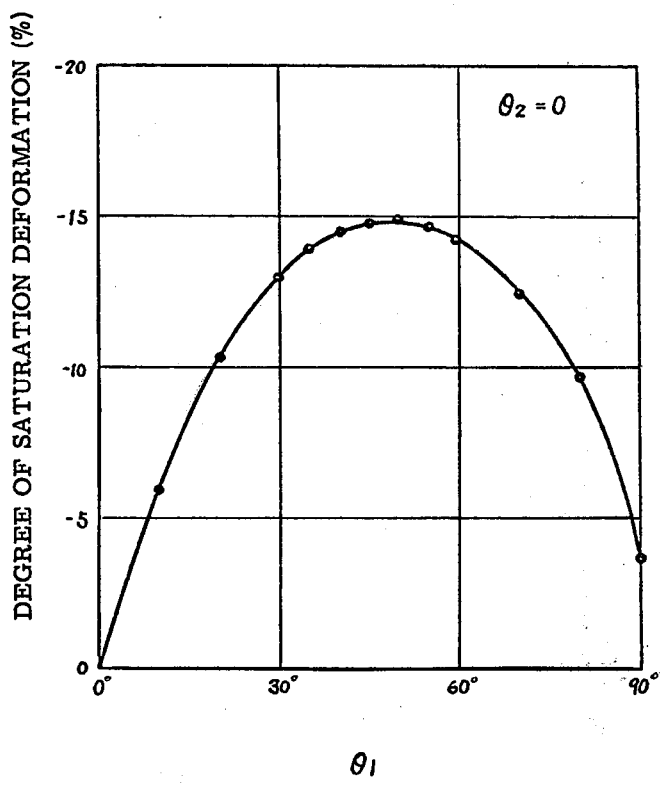
FIG. 6 is a graph relating the degree of saturation deformation to the pressuring direction.

The degree of saturation deformation is given by theoretically calculating, on the basis of the mechanism of transformation of Example 3, the degree of deformation measured as it reaches the saturation in the pressuring direction, when the $\epsilon_c$(M) monocrystal turns into the $\epsilon_c$(M) monocrystal by way of $\epsilon_c \rightarrow \epsilon'_c \rightarrow \tau_c$ transformation due to the slide of the plane of atoms in the specific direction mentioned in Example 3. Accordingly, the degree of saturation deformation differs, depending on the pressuring direction. For example, the degree of saturation deformation obtained when $\theta_1$ was changed, with $\theta_2 = 0°$, are shown in FIG. 6. Test pieces deformed beyond the degrees of their saturation deformation showed isotropic elongation, were not directionally oriented in their magnetic characteristics, and were all ascertained to consist of a multi-directionally oriented $\tau_c$(M) phase, as examined by way of X-ray diffraction.

EXAMPLE 5

From the same $\epsilon_c(\mu)$ monocrystal as in Example 3, a cubic test piece of 8 × 8 × 8 mm having faces of (0001), $(1\bar{1}00)$ and $(11\bar{2}0)$ was cut out, and then it was held at a temperature of 500° C for 5 minutes. The phase structure of this test piece was examined by way of X-ray diffraction; as the result, it was recognized that the $\epsilon'$c(M) phase occupies a greater part of the phase of the test piece.

This test piece was pressured and deformed at a temperature of 550° C, at pressure of of 35 kg/mm² in the direction perpendicular to $(1\bar{1}00)$ plane and its magnetic characteristics were measured. The magnetic characteristics found in the pressuring direction were;

Br = 5300 G, $_B$Hc = 2200 Oe, (BH)max = $4.1 \times 10^6$ G.Oe

Then, this test piece was held further at a temperature of 600° C for one hour, as the result, an anisotropic magnet was obtained, having magnetic characteristics of:

Br = 5700 G, $_B$Hc = 2100 Oe, (BH)max = $5.2 \times 10^6$ G.Oe

Thus, it was clarified that the anisotropic Mn-Al-C alloy magnet can be obtained by deforming the $\epsilon'_c$(M) phase.

EXAMPLE 6

A Mn-Al-C alloy having the unidirectional $\tau_c$(M) phase manufactured by the methods of Examples 3 and 4 was subjected to a warm plastic deformation with the pressuring direction altered.

The test piece $S_9$ in the unidirectional $\tau_c$(M) phase manufactured by way of a warm plastic deforming and tempering in Example 4 was pressured again by applying a pressure of 40 kg/mm² at a temperature of 600° C in the same direction as that of the initial pressuring. In that operation, barely any deformation took place. Then, as the pressuring was continued, with the pressure further increased to 80 kg/mm², the test piece shrunk by 8% in the pressuring direction, and isotropically elongated at a right angle to the pressuring direction. Measurement of the magnetic characteristics of the test piece after being pressured showed that the unidirectional orientation of the $\tau_c$(M) phase are disturbed, and the magnetic characteristic in the preferred direction of magnetization before making the pressuring greatly lowered the BHmax to $3.8 \times 10^6$ G.Oe.

Figure 3:
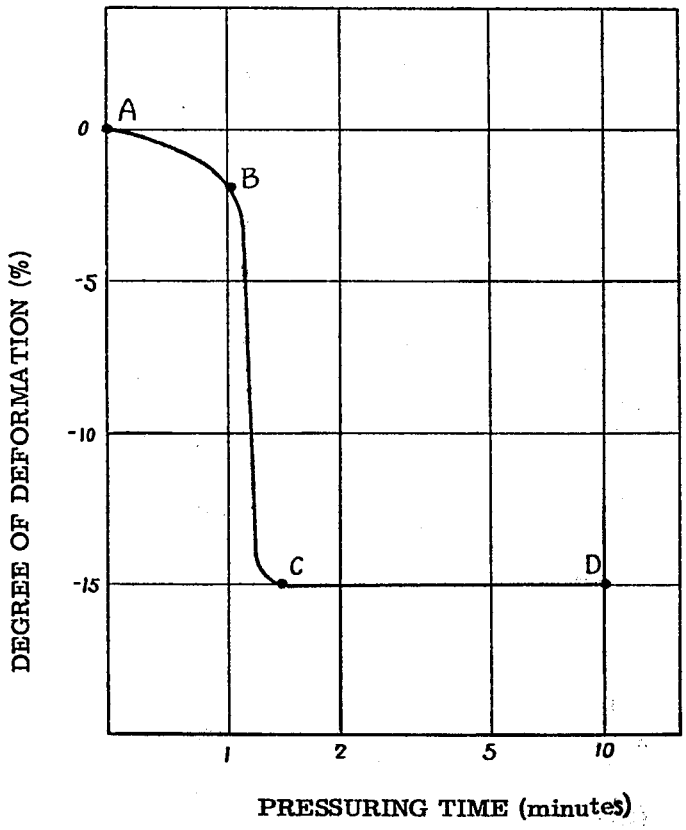
FIG. 3 depicts a graph relating the pressuring time and the degree of deformation in the pressuring direction when the monocrystal in $\epsilon_c$(M) was subjected to plastic deformation.

As the test piece of $S_3$ consisting of the monocrystal in the $\tau_c$ (M) phase after being tempered in Example 3 was pressured again by applying a pressure of 40 kg/mm² at a temperature of 600° C in the direction parallel to the direction of easy magnetization which was nearly at a right angle to the initial pressuring direction, a rapid plastic deformation reaching the similar saturation as that of FIG. 3 was observed. The degree of shrinkage in the pressuring direction reached −27%, while the elongation in the direction at a right angle to the pressuring direction was as large as 28% in the direction parallel to the initial pressuring direction, and only about 1% elongation was recognized in another right angle direction; thus a directional difference in elongation was evident. As the magnetic characteristics of this test piece were measured, the preferred direction of magnetization greatly shifted toward the direction in which a notable elongation took place, that is, the direction nearly parallel to the initial pressuring direction, and accordingly, the magnetic characteristics in the preferred direction of magnetization observed before making the pressuring, that is, the pressuring direction, were distinctly lowered.

The phenomena of the notable plastic deformation taking place as the monocrystalline test piece in the $\tau_c$(M) phase is pressured in the preferred direction of magnetization, and of the preferred direction of magnetization greatly shifting, as noted by the examination of X-ray diffraction and electron-microscopic observations, were clarified to be based on the reversibility of the $\epsilon'_c \rightleftarrows \tau_c$ transformation involving the slide of the plane of atoms in just the opposite direction to that specific direction in which the slide of the plane of atoms occurs in the previously described $\epsilon'_c \rightarrow \tau_c$ transformation.

As the monocrystal in the $\tau_c$(M) phase formed by the $\epsilon'_c \rightarrow \tau_c$ transformation of Example 3 is pressured in the preferred direction of magnetization, that is, in the direction of $\tau_c$[001], the surface of atoms parallel to the $\tau_c$(111) plane which holds the relationship of $\epsilon'_c$ (100) // $\tau_c$(111), slides by a specific distance, receiving the stress in the direction of $\tau_c$[II2]. This transfer of the plane of atoms is a slide just in opposite direction to that of the transfer in the $\epsilon'_c$[001] direction in the plane of atoms parallel to the $\epsilon'_c$(100) plane in the $\epsilon'_c \rightarrow \tau_c$ transformation which corresponds to the $\tau_c \rightarrow \epsilon'_c$ transformation. Furthermore, from the $\epsilon'_c$ phase formed by the $\tau_c \rightarrow \epsilon_c$ transformation, by sliding it a specific distance in the direction of the $\epsilon'_c$[001] in the plane of atoms parallel to the $\epsilon'_c$ plane, a new unidirectional $\tau_c$ phase which is different in crystalline azimuth from the $\tau_c$ phase before making the pressuring is formed. Such a slide of the plane of atoms parallel to the $\tau_c$(111) plane was recognized only on the plane of atoms parallel to the $\tau_c$ (111) plane which holds the relationship of $\epsilon'_c$(100)//$\tau_c$(111), but the surface of atoms parallel to a group of other $\tau_c$(111) planes differing in the surface direction evidenced no slide. The structure after making the pressuring, as examined on an optical microscope, was found to be a uniform smooth structure except for the lamellar $Mn_3AlC$ phase, just as described in Example 3, and such structures as that having slip lines and the like were not observed. The magnetic characteristics of the newly formed $\tau_c$(M) phase in the preferred direction of magnetization were found to be:

Br = 6,850 G $_B$Hc = 1,900 G (BH)mas = 7.0 × $10^6$ G.Oe

As the test piece of $S_{15}$ of Example 4 having two different $\tau_c$[001] axes was pressured by applying a pressure of 25 kg/mm² at a temperature of 600° C in the direction parallel to one $\tau_c$[001] axis, a rapid plastic deformation reaching the similar saturation as that of FIG. 3 was observed, and a directional difference in elongation was recognized. As the test piece which has been pressured was examined by way of X-ray diffraction, it was confirmed that this test piece was in a unidirectinal $\tau_c$(M) phase, that the direction of its $\tau_c$ [001] axis was parallel to the direction of one $\tau_c$ [001] axis observed before making the pressuring which differed from the pressuring direction and that one $\tau_c$ [001] axis was shifted to the other $\tau_c$ [001] axis by the pressuring. This shifting of $\tau_c$[001] axis was determined to be based on the reversibility of the $\epsilon'_c \rightleftarrows \tau_c$ transformation above described. The preferred direction of magnetization of the test piece which had been deformed was found identical to the direction of the $\tau_c$[001] axis, and its magnetic characteristics were found to be:

Br = 6,800 G Hc = 1,850 Oe BHmax = 6.9 × $10^6$ G.Oe showing an improved Br, as compared with the magnetic characteristic in the preferred direction of magnetization observed before the deformation. Besides, it was determined that it is hard to cause the $\tau_c \rightarrow \epsilon'_c$ transformation at a temperature other than 50° C above that which causes $\epsilon'_c \rightarrow \tau_c$ transformation, and that deformation velocity of test piece in $\epsilon'_c \rightleftarrows \tau_c$ transformation increases with temperature rise up to 750° C.

EXAMPLE 7

From a monocrystal in the $\epsilon_c$ phase having a composition of Mn 71.95%, Al 26.95% and C 1.10%, as chemically analyzed, which had been manufactured by a method similar to that of Example 1, cubic or rectangular test pieces having varied crystalline surfaces and sides of 5 ~ 12 mm were cut out, and each test piece was put to the similar tests as those of Examples 3 and 4. Then, results showing qualitatively the similar tendencies as observed in Examples 3 and 4 in the relationship between the pressuring direction and the degree of deformation, the relationship between the pressuring direction and the degree of anisotropization, etc., were observed and the existence of the $\epsilon'_c$ phase was confirmed by way of X-ray diffraction.

The experimental results obtained with a test piece in the $\epsilon_c$ phase having no lamellar $Mn_3AlC$ phase, as compared with the test results with the test pieces of Examples 3 and 4 in which $Mn_3AlC$ was separated in lamellae, showed that its deformability was low, accordingly that, while in the cases of Examples 3 and 4, pressure of only 15 ~40 kg/mm² were required for making the deformation, in this case, a pressure of 35 ~ 60 kg/mm² being several ten percentages larger than those above mention was needed, and that even the anisotropic magnet, because of the low orientation in its $\tau_c$ phase, was found to be an anisotropic magnet with inferior magnetic characteristics to those of Examples 3 and 4.

For example, as a monocrystalline $\epsilon_c$ test piece consisting of the above-mentioned composition was pressured in the pressuring direction of $\theta_1 = 90°$, $\theta_2 = 0°$ and under the condition of the pressuring temperature being 560° C and the pressuring force 50 kg/mm², the degree of deformation in the pressuring direction was found to be −1.9%, and the measurements of its magnetic characteristics showed it to be quite nonmagnetic. As the test piece which had been pressured was examined by way of X-ray diffraction in varied directions, only the diffraction pattern from the $\epsilon'_c$ phase was observed, and it was found to have its $\epsilon'_c$ [001] axis mainly in the pressuring direction, but was not identified as a monocrystal. Then, as its phase was observed under an optical microscope, a structure nearly crisscrossing was recognized in the surface of the test piece, and a crystal in the $\epsilon'_c$ phase differing in crystalline azimuth was observed. As the test piece which had been pressured was subjected to a tempering at 570° C for 4 hours, an anisotropic magnet with its preferred direction of magnetization in the pressuring direction was obtained.

Its magnetic characteristics were found in the pressuring direction to be:

Br = 5,450 G $_B$Hc = 2,200 Oe BHmax = 3.3 × $10^6$G.Oe

In the direction at a right angle to the pressuring direction and corresponding to the [11$\bar{2}$0] direction before making the pressuring the magnetic characteristics were:

Br = 1,000 G $_B$Hc = 600 Oe BHmax = 0.2 × $10^6$G.Oe

In another direction at a right angle to the pressuring direction the magnetic characteristics were:

Br = 2,400 G $_{BHc}$ = 1,400 Oe (BH)max = 0.9 × $10^6$G.Oe

Comparing these values of magnetic characteristics with those of magnetic characteristics obtained in the similar experiment in Example 4, Br was found about 20% lower in the preferred direction of magnetization, (BH)max about one half, and the degree of angularity of the magnetization curve in the second quadrant was lessened, showing a lowered degree of anisotropizaiton from that of Example 4.

Moreover, even when the above-mentioned conditions of the pressuring temperature, pressuring force and the degree of deformation, and the tempering condition after making the pressuring were altered, any further improvement in the magnetic characteristics was recognized.

Furthermore, when the pressuring direction was widely varied, every test piece, as compared with those of Example 4, gave magnetic characteristics of Br being about 10 ~ 30% lower and (BH)max about one half, showing an essential difference due to the existence of the $Mn_3AlC$ phase from the results of Example 4.

As the causes of the difference in the magnetic characteristics between Example 4 and Example 7 were examined by way of optical microscope and X-ray diffraction, it was determined that in the process of warm deformation of Example 4, the lamellar $Mn_3AlC$ phase had the effect of enhancing the orientation of the $\epsilon_c'$ phase by subduing the evolution of such multi-directional $\epsilon_c'$ phases as the twin of the matrix $\epsilon_c'$ phase, and accordingly, the orientation of the matrix $\tau_c$ phase, after being tempered, as observed in Example 4, was superior to that of Example 7, showing a remarkable improvement in magnetic characteristics over the results of Example 7.

As described hereabove, the $Mn_3AlC$ phase separated out in lamellae by the M treatment has not only the effect of facilitating the sliding of the plane of atoms in the Mn-Al-C alloys, thereby making the warm deformation with a low pressure feasible, but also the effect of enhancing the directionalization by controlling the azimuth in the formation of the crystal. Accordingly, it became evident that the existence of the lamellar $Mn_3AlC$ phase is very important in the obtention of anisotropic magnets high in the degree of anisotropization and having quite excellent magnetic characteristics.

EXAMPLE 8

An attempt was made to manufacture the $\epsilon$ monocrystal from an Mn-Al alloy having a composition of Mn 71.81%, Al 28.19%, as chemically analyzed, by the melting and cooling method, as in Example 1. The alloy obtained was a polycrystal in which the remaining $\epsilon$ phase was very small in amount; the most part consisted of the $\beta$-Mn phase and the AlMn($\gamma$) phase, and some part was recognized to be the $\tau$ phase. A nearly similar tendency as above mentioned was observed when the composition of Mn and Al, melting conditions and cooling conditions were widely varied, and notable cracks developed when the alloy was quenched into water from such a high temperature as above 900° C in order to obtain the $\epsilon$ phase. On the other hand, when a Mn-Al binary alloy of the same composition, as mentioned above, was heated for 1 week at a temperature of 1,100° ~ 1,200° C, to accelerate its recrystallization as the $\epsilon$ phase, and was then quenched into water from this temperature, the test specimen had heavy cracks, but the $\epsilon$ phase having particle diameters of about 3 ~ 5 mm could be obtained. From this crystal in the $\epsilon$ phase, cubic test pieces of 3 × 3 × 3 mm having surfaces parallel to (3$\bar{3}$04), (11$\bar{2}$0) and (3$\bar{3}$0$\bar{8}$) which were chosen from among parts having relatively large crystalline grains were cut out, and were pressured to a degree of deformation of −14.7% under a condition of pressuring with a force of 40 kg/mm$^2$, at a temperature of 530° C in the direction of $\theta_1 = 55°$ and $\theta_2 = 0°$, i.e., in the direction perpendicular to the (3$\bar{3}$04) plane.

The test piece was found out to be an isotropic magnet; its elongation was isotropic, and its magnetic characteristics were:

Br = 1,350 G $_B$Hc = 650 Oe BHmax = 0.2 × $10^6$G.Oe

As the test speciment after being deformed was examined by way of X-ray diffraction, the existence of the diffracted lines from the $\tau$ phase, $\beta$-Mn phase and AlMn($\gamma$) phase was evident, but the orientation of the $\tau$ phase was barely recognizable.

Even when the pressuring temperature, the pressure and the degree of deformation were widely varied, the similar tendency as above mentioned prevailed, and test pieces being in the $\tau$ phase only could not be obtained, which evidences lack of anisotropization. This result is believed to be due to the low stability of the $\epsilon$ phase and the $\tau$ phase. Also, it is difficult that in the Mn-Al alloys, unlike the Mn-Al-C alloys, the $\tau$ the phase exists at above 530° C, and also their decomposition to the AlMn ($\gamma$) phase and the B-Mn phase is accelerated by the war deformation. Moreover, the directional control effect by the lamellar $Mn_3AlC$ phase above directional is absent.

EXAMPLE 9

A monocrystal or a polycrystal within large crystalline grains in the $\epsilon$ or $\epsilon_c$(M) phase of Mn-Al-C alloys with its composition of Mn, Al and C varied within the range of Mn 67.0 ~ 74.0% and C 0.1 ~2.5% was manufactured, and from these crystals, monocrystal test pieces in the $\epsilon$ or $\epsilon_c$(M) phase were cut out, and were then pressured at 40 kg/mm$^2$ at a temperature of 570° C in the direction of $0_1 = 55°$ and $0_2 = 0°$ In Table 4, the values off compositions obtained by chemical analysis and the values of magnetic characteristics in the preferred direction of magnetization measured after tempering following the pressuring, are respectively shown.

The test pieces of $S_{23}$ and $S_{24}$ containing carbon in amounts falling short of its solubility limit (1/10M–6.6)% were barely turned anisotropic, and with the AlMn($\gamma$) phase and the $\beta$-Mn phase separated, their magnetic characteristics were low in isotropy. The test piece of $S_{25}$ had a large amount of the $\beta$-Mn phase, and that of $S_{30}$ a plenty of the AlMn($\gamma$) phase; both were low in the degree of anisotropization, and gave low magnetic characteristics. All the test specimens of $S_{31}$, $S_{32}$, and $S_{33}$ containing carbon in amounts in excess of ⅓Mn – 22.2)% had an $Al_4Chd$ 3 phase already before being deformed, were low in the degree of anisotropization even after being deformed, and gave nearly isotropic magnetic characteristics. In all these test specimens, $S_{31}$, $S_{32}$ and $S_{33}$, the decaying phenomenon was recognized. In test specimen $S_{29}$, the AlMn ($\gamma$) phase was slightly recognized.

Even when the pressuring condition of direction, temperature and degree of deformation and the tempering condition were varied in conducting the experiment with test pieces giving less than BHmax = 2.0 $\times 10^6$G.Oe, only such low magnetic characteristics as below BHmax = 2.0 $\times 10^6$G.Oe were achieved.

Table 4

| | Mn (%) | Al (%) | C (%) | Br (G) | $_B$HC (Oe) | (BH)max ($\times 10^6$G.Oe) |
|---|---|---|---|---|---|---|
| $S_{23}$ | 72.02 | 27.43 | 0.55 | 1400 | 900 | 0.4 |
| $S_{24}$ | 69.77 | 30.04 | 0.19 | 1100 | 550 | 0.2 |
| $S_{25}$ | 73.44 | 25.53 | 1.03 | 2500 | 1250 | 0.9 |
| $S_{26}$ | 72.89 | 25.86 | 1.25 | 6450 | 2350 | 6.4 |
| $S_{27}$ | 71.58 | 27.22 | 1.20 | 6900 | 2250 | 9.0 |
| $S_{28}$ | 70.72 | 28.29 | 0.99 | 6750 | 2200 | 8.0 |
| $S_{29}$ | 68.14 | 31.41 | 0.45 | 6550 | 1900 | 6.8 |
| $S_{30}$ | 67.63 | 32.17 | 0.20 | 1800 | 850 | 0.5 |
| $S_{31}$ | 71.40 | 26.42 | 2.18 | 2500 | 1400 | 1.1 |
| $S_{32}$ | 70.78 | 27.77 | 1.45 | 2750 | 1300 | 1.1 |
| $S_{33}$ | 69.90 | 28.77 | 1.33 | 2600 | 1250 | 1.0 |

From the experimental results described hereabove, it became evident that to attain excellent magnetic characteristics higher than BHmax = 6.0 × $10^6$G.Oe, the composition should be limited to the following ranges:

Mn 68.0 ~ 73.0%
C (1/10Mn ~ 6.6) ~ (⅓Mn ~ 22.2)%
Al remainder

EXAMPLE 10

Mn 72%, Al 27% and C 1% were mixed. The mixture was melted at about 1,400° C for 20 minutes, and ws then, cast in a chill mold. The casting obtained had Mn 71. 83%, Al 27.19% and C 0.98%, as chemically analyzed, and columnar crystals were observed under an optical microscope in the initially solidified parts. As this casting was subjected to the M treatment at 850° C for 20 minutes, and was then, quenched from this temperature, a separation of lamellar $Mn_3AlC$ ws recognized in the columnar crystalline grains the lamellar pattern showing abounding crystalline grains which make about a right angle to the growing direction of the columnar crystals. As this casting was examined by way of X-ray diffraction, the diffracted lines from the $\epsilon_c$ phase and the lamellar $Mn_3AlC$ phase were detected.

From this casting, a cubic test piece of 6 × 6 × 6 mm having a surface perpendicular to the growing direction of the columnar crystal was cut out, and then was pressured under a temperature of 650° C and presure of 45 kg/mm². The degree of deformation of the test piece in the pressuring direction was found to be −25.5%. The test piece after being pressured was nonmagnetic, but when tempered at 570° C for 4 hours, it turned into an anisotropic magnet with its preferred direction of magnetization at a right angle to the pressuring direction. Its magnetic characteristics, as measured in the pressuring direction, were found to be:

Br = 2,800 G $_B$Hc = 1,500 Oe $(BH)_{max}$ = 1.1 × $10^6$G.Oe

In one direction at a right angle to the pressuring direction and parallel to the growing direction of the columnar crystal bfore being pressured the magnetic characteristics were:

Br = 4,300 G Hc = 2,350 Oe $(BH)_{max}$ = 3.6 × $10^6$G.Oe

In another direction at a right angle to the pressuring direction:

Br = 4,750 G Hc = 2,400 Oe $(BH)_{max}$ = 4.9 × $10^6$G.Oe

EXAMPLE 11

Rod shape castings of 9 kaids of Mn-Al-C alloys, $P_1$ ~ $P_9$, having the composition ratios listed in Table 5, were manufactured by melting and casting. Melting was performed by holding at temperature of 1,430° C for 30 minutes to melt carbon well into its solid solution. Cylindrical test pieces of 20mm$\phi$ × 25mm were respectively cut out from them. Then, after subjecting each test piece cut out to the heat treatment in which after heating it at a temperature of 1,150° C for 2 hours, it was gradually cooled from this temperature to 830° C at a cooling rate of 10° ~ 15° C/min, and was then held at 830° C for 20 minutes, it was quenched from 830° C at a cooling rate of 300° ~ 3,000° C/min, and was further subjected to a heat treatment of tempering at 600° C for 1 hour. As each test specimen which had been subjected to the heat treatment was examined as to its phase structure by way of X-ray diffraction, optical microscopy and electron microscopy, in the test pieces of the compositions of $P_3$ ~ $P_9$ containing carbon in excess of its solubility limit (1/10 Mn – 6.6)%, the lamellar $Mn_3AlC$ phase and/or face centered cubic phase being similar thereto and more especially, in test pieces of the composition of $P_3$, $P_4$, $P_5$, $P_8$, was recognized clearly. But in the test pieces of the compositions of $P_1$ ~ $P_2$ with the amount of carbon falling short of the solubility limit, the lamellar $Mn_3AlC$ phase and/or face centered cubic phase being similar thereto was not seen at all. In the test pieces of the compositions of $P_8$ $P_9$ with the amount of carbon running in excess of (⅓Mn – 22.2)%, a separation of $Al_4C_3$, in addition to the $\Delta_c$ phase and lamellar $Mn_3AlC$, and/or face centered cubic phase being similar thereto, was observed, and in the test piece of the composition of $P_3$, the $\beta$-Mn phase, and in the test piece of the composition of $P_7$, the AlMn($\gamma$) phase, were respectively found existing in a large amount, In test piece of composition of $P_6$, and AlMn($\gamma$) phase was recognized slightly.

These test specimens were respectively subjected to the following warm deformation.

A test piece having the composition of $P_1$ is compressed by pressuring it at a temperature of 680° C, a pressure of 50 kg/mm² and in the axial direction to the cylinder to a degree of deformation of −25% in the pressuring direction. In the test piece which had been subjected to the deformation, numerous cracks were found developing. Its magnetic Table 5

| | Mn | Al | C |
|---|---|---|---|
| $P_1$ | 72.08 | 27.45 | 0.47 |
| $P_2$ | 70.21 | 29.55 | 0.24 |
| $P_3$ | 73.44 | 25.51 | 1.05 |
| $P_4$ | 72.36 | 26.40 | 1.24 |
| $P_5$ | 71.63 | 27.23 | 1.14 |
| $P_6$ | 68.86 | 30.78 | 0.40 |
| $P_7$ | 67.86 | 31.81 | 0.33 |
| $P_8$ | 71.66 | 26.35 | 1.99 |
| $P_9$ | 69.90 | 28.67 | 1.43 |

characteristics greatly declined from the characteristic of $(BH)_{max} = 0.6 \times 10^6$G.Oe, as measured before making the pressuring, to:

Br = 1,700 G $_B$Hc = 700 Oe $(BH)_{max}$ = 0.3 × $10^6$G.Oe showing it to be isotropic. As this test piece was examined by way of X-ray diffraction, large amount of the $\beta$-mn phase and AlMn($\gamma$) phase were recognized, other than a small amount of remaining $\tau$ phase, and the additional heat treatment of tempering merely caused a further decline in its magnetic characteristics.

A test piece having the composition of $P_2$ was subjected to a deformation to the degree of deformation of −50% by pressuring it at a temperature of 710° C, a pressure of 55 kg/mm² and in the axial direction of the cylinder. The test piece which had been subjected to this deformation was found to be pulverized, and its lumpy grains showed barely any magnetism, as a magnet approached it. As this test piece which had been subjected to this deformation was examined by way of X-ray diffraction, the existence of the $\tau$ phase was not recognized at all; only the AlMn($\gamma$) phase and the $\beta$-Mn phase were detected. This is believed to be due to the fact that its decomposition from the $\tau$ phase to the AlMn($\gamma$) phase and $\beta$-Mn phase was accelerated by this warm deformation just as in the case of $P_1$ above described.

A test piece having the composition of $P_3$ was subjected to a compression deformation to a degree of deformation of −40% by pressuring it at a pressure of 50 kg/mm², at a temperature of 630° C and the axial direction of the cylinder. The test piece which had been subjected to this deforming showed its preferred direction of magnetization in the direction of its diameter but the magnetic characteristics found in this direction were only;

Br = 2,600 G $_B$Hc = 1,500 Oe $(BH)_{max}$ = 1.0 × $10^6$G.Oe

Thus, its magnetic charactristics were not improved even by an additional tempering treatment. As the test piece which had been subjected to this deforming was examined by way of X-ray diffraction, the $\beta$-Mn phase was noted in a large amount, which was believed to have worked against the upgrading of its magnetic characteristics.

A test piece having the composition of $P_4$ was extruded to a degree of 65%, at a pressure of 40 kg/mm² and a temperature of 720° C, and in the axial direction of the cylinder. The degree of extrusion is expressed by the percentage of the decrease in the sectional area of the test piece, as measured before and after being extruded. The test piece which had been subjected to the extrusion was found to be an excellent anisotropic magnet with its preferred direction of magnetization in the axial direction of the extruding direction, namely, the axial direction of the cylindrical test piece, and its magnetic characteristics in the preferred direction of magnetization were:

Br = 6,100 G $_B$Hc = 2,200 Oe $(BH)_{max}$ = 5.5 × $10^6$G.Oe

As the test piece which had been subjected to the extrustion was examined as to its phase structure by way of X-ray diffraction and optical microscopic observation, it was found to be in the $\tau_c$ phase and the lamellar $Mn_3AlC$ phase, and a streak pattern of the lamellar $Mn_3AlC$ phae nearly parallel to the extruding direction was noticed. A test piece having the composition of $P_4$ was subjected to a compression to a degree of deformation of −53% by applying a pressuring force of 45 kg/mm² in the axial direction of its cylinder at 650° C. The preferred direction of magnetization of the deformed specimen was found in the diameter direction of it, with its magnetic characteristics being:

Br = 4,900 G $_B$Hc = 2,600 Oe $(BH)_{max}$= 4.3 ×$10^6$G.Oe

A test piece having the composition of $P_5$ was subjected to a compression to a degree of deformation of −65%, by applying a pressuring force of 45 kg/mm² in the axial direction of its cylinder at 680° C. The preferred direction of magnetization of the deformed specimen was found in the diameter direction or it, with its magnetic characteristics being:

Br = 5,050 G $_B$Hc = 2600 Oe (BH)max = 4.6× $10^6$ G.Oe

A test piece having the composition of $P_5$ was subjected to an extrusion to a degree of extrusion of 65% by applying a pressuring force of 40 kg/mm² in the axial direction of its cylinder at 630° C. The preferred direction of magnetization of the extruded specimen was found in the extruding direction with its magnetic characteristics being:

Br = 5,850 G $_B$Hc = 2,250 Oe (BH)max ' 5.7 × $10^6$ G.Oe

The test pieces having the composition of $P_5$ were subjected to an extrusion to a degree of extrusion of 50% in the axial direction of its cylinder, with the extruding temperature varied in the range of 500° to 850° C. Table 6 shows the relation between the extruding temperature and the magnetic properties in the preferred direction of magnetization. Below the extruding temperature of 500° C, just as in the case of Examples 4, the test piece had little plasticity; its extrusion was difficult; the development of cracks was notable, and it failed to become anisotropic. At a temperature above 830° C also, it showed decreasing plasticity, with accompanying cracks, and failed to become anisotropic. Then in the range of extruding temperature of 580°~830° C, excellent anisotropic magnets giving (BH)max higher than 4.8 × $10^6$ G.Oe were obtained.

Table 6

| Temperature (° C) | Br (G) | $_B$Hc (Oe) | BHmax (×$10^6$G.Oe) |
|---|---|---|---|
| 500 | 2,700 | 1,400 | 1.1 |
| 580 | 5,650 | 2,050 | 5.0 |
| 630 | 6,050 | 2,150 | 5.6 |
| 730 | 6,000 | 2,100 | 5.5 |
| 830 | 5,500 | 2,000 | 4.8 |
| 850 | 2,550 | 950 | 0.7 |

A test piece having the composition of $P_6$ was subjected to an extrusion by pressuring to the degree of extrusion of 31% with a force of 40 kg/mm² at a temperature of 700° C and in the axial direction of its cylinder. The test piece which had been subjected to this working showed the following magnetic characteristics in the extruding direction.

Br = 4,350 G $_{B}$Hc = 1,600 Oe (BH)max 2.4 × $10^6$G.Oe

As this test piece which had been subjected to extrusion was further extruded to a degree of extrusion of 25% by applying a pressuring force of 25 kg/mm² in the same direction at a temperature of 700° C, its magnetic characteristics in the extruding direction were found to be:

Br = 5,700 G $_{B}$Hc = 1,950 OE BHmax = 5.0 × $10^6$G.Oe

A test piece having the composition of $P_7$ was extruded to a degree of extrusion of 50% by applying a pressuring force of 45 kg/mm² in the axial direction of its cylinder at a temperature of 780° C. On the test piece which was subjected to this extrusion, cracks developed nearly perpendicular to the extruding direction. Its magnetic characteristics in the extruding direction, thus its preferred direction of magnetization, were found to be:

Br = 2,750 G $_{B}$Hc = 1,700 Oe (BH)max = 1.8 × $10^6$G.Oe

A test piece having the composition of $P_8$ was subjected to a compression to a degree of deformation of −76% by applying a pressuring force of 50 kg/mm² in the axial direction of its cylinder at a temperature of 750° C. On the test piece which was subjected to this compression, cracks developed in the diameter direction around its perimeter. Its preferred direction was found in the diameter direction of the test piece, with its magnetic characteristics being:

Br = 3,800 G $_{B}$Hc = 1,800 Oe (BH)max = 2.1 × $10^6$G.Oe

This test piece had $Al_4C_3$ separated in it, and began disintegrating several days thence. A test piece having the composition of $P_9$ was subjected to a compression to a degree of deformation of −35% by applying a pressuring force of 55 kg/mm² in the axial direction of its cylinder at 700° C. Its preferred direction of magnetization of the deformed specimen was found in the diameter direction of it, with its magnetic characteristics being:

Br = 3,400 G $_{B}$Hc = 1,700 Oe (BH)max = 1.9 × $10^6$G.Oe

This specimen had $Al_4C_3$ separated in it, and began disintegrating several days thence.

As demonstrated by the examples above described, the test pieces being in the phase of $\tau_C$(M) showed excellent plasticity in the temperature range of 530° ~ 830° C, and become highly anisotropic by the warm deformation and thus, these test pieces were identified as anisotropic magnets having very excellent magnetic characteristics. On the other hand, when the lamellar $Mn_3AlC$ phase was absent in the test pieces or when phases other than the $\tau_c$ phase, for example, the phases of $Al_4C_3$, B-Mn or AlMn ($\gamma$) existed, their plasticity was found improper; the degree of their anisotropization was also slight, and their magnetic characteristics were low.

Accordingly, as the condition for obtaining excellent anisotropic magnets, it is necessary to have their compositions falling within the ranges of Mn 68.0 ~ 73.0%, C (1/10Mn − 6.6)% ~ (⅓ Mn − 22.2)% and remainder Al, preferably within the ranges of Mn 70.5 − 72.5%, C(1/10 Mn − 6.6) ~ (⅓ Mn − 22.2)% and the remainder Al. Also, it is necessary to subject the $\tau_c$(M) phase with such composition ranges to a warm plastic deformation in the temperature range of 530°~830° C, especially by an extrusion to a degree of 40 ~ 65%. The resultant anisotropic magnets have excellent magnetic characteristics, i.e. (BH)max higher than 4.8 × $10^6$ G.Oe. Furthermore, the mechanical strength measured after the warm deformation showed a marked improvement, and also the machinability was excellent.

EXAMPLE 12

From a casting similar to that of Example 11 having a composition of $P_5$, a cylindrical test piece of 20 mm$\phi$ × 35 mm was cut out. After holding it at a temperature of 1,000° C for 5 hours, it was cooled to 835° C at a cooling rate of 10° C/min., and then further quenched from this temperature at a cooling rate of 300° ~ 3,000° C/min. Then, as this test piece was held at 500° C for 10 minutes, it was confirmed by way of X-ray diffraction and optical microscopic observation of its phase structure that about 70% was the $\epsilon_c$(M) phase, and the remaining about 30%, the $\tau_c$(M) phase.

This test piece was extruded to a degree of extrusion of 40% by applying a force of 40 kg/mm² at a temperature of 730° C in the axial direction of its cylinder. As the magnetic characteristics in the extruding direction of the test piece after being extruded were found low, and the existence of the $\epsilon_c'$ phase was recognized by the X-ray diffraction, then it was further tempered at 600° C for 2 hours. In this way, an anisotropic magnet having very excellent magnetic characteristics with its preferred direction of magnetization in its axial direction was obtained. Its magnetic characteristics in the preferred direction of magnetization were found to be:

Br = 6,200 G $_{B}$Hc = 2,300 Oe (BH)max = 6.0 × $10^6$G.Oe

The test piece had a very high mechanical strength, and machinability after extrusion, giving values equal or higher than those obtained in Examples 11.

EXAMPLE 13

From the same casting of Example 11 having the composition of $P_5$, a cylindrical test piece of 20$\phi$ × 35 mm was cut out, cooled down to 1,000° C after holding it at a temperature of 1,150° C for 2 hours, and then quenched from this temperature at a cooling rate within the range 300° ~ 3,000° C./min.

This test piece in the $\epsilon_c$ phase after being quenched was extruded to a degree of extrusion of 40% by applying a pressuring force of 60 kg/mm² at a temperature of 730° C in the axial direction of its cylinder. Its deformation velocity was lower than that in the extrusion of the $\tau_c$(M) phase test piece of the same composition of Example 11, showing low deformability. The test piece, after being extruded, was found to be in the $\epsilon_c$ phase and $\epsilon'_c$ phase, as examined by way of X-ray diffraction.

The magnetic characteristics of the test piece after being extruded, as measured after tempering it at 600° C for 2 hours, were found, in the extruding direction, to be:

Br = 5,200 G $_{B}$Hc = 1,950 Oe (BH)max = 4.8 × $10^6$G.Oe

It was identified as an anisotropic magnet with its preferred direction of magnetization in the extrusion direction. This test piece had a very high mechanical strength and machinability, giving values equal or higher than those obtained in Examples 11 and 12.

EXAMPLE 14

From the same castings of Example 11 having the compositions of $P_1 \sim P_9$ listed on Table 5, cylindrical test pieces of 20mm$\phi$ × 35 mm were respectively cut out. These test pieces were gradually cooled down to 830° C at a cooling rate of 10° C/min. after holding them at 1,150° C for 2 hours, and then they were subjected to the M treatment in which they were held at a temperature of 830° C for 20 minutes, subsequently they were quenched at a cooling rate of 1,000° C./min from this temperature.

As the phase structures of these test pieces after being quenched were examined by way of X-ray diffraction, optical microscopy and electron microscopy, in the test pieces of the compositions of $P_3 \sim P_9$ containing carbon in excess of its solubility limit of (1/10 Mn − 6.6)%, the lamillar $Mn_3AlC$ phase and/or face centered cubic phase being similar thereto was recognized, but in the test pieces of the compositions of $P_1$ and $P_2$ containing carbon falling short of its solubility limit, the lamellar $Mn_3AlC$ phase and/or face centered cubic phase being similar thereto was not seen at all. In the test pieces of the compositions of $P_8$ and $P_9$ containing carbon in excess of (⅓ Mn − 22.2)%, the existence of $Al_4C_3$, besides the $\epsilon_c$ phase and the lamellar $Mn_3AlC$ phase and/or face centered cubic phase being similar thereto was noticed. Then, in the test piece of the composition of $P_3$, the $\beta$-Mn phase, and in the test piece having the composition of $P_7$, the AlMn($\gamma$) phase, were respectively much observed. The test piece having the composition of $P_1$ was found to have a small amount of the $\epsilon$ phase and large amounts of the AlMn($\gamma$) phase and the $\beta$-Mn phase, while in the test piece of the composition of $P_2$, nearly equal amounts respectively of the $\tau$ phase, $\beta$-Mn phase and AlMn($\gamma$) phase existed in admixture, but the $\epsilon$ phase was not detected at all.

These test pieces after being heat treated were respectively subjected to the warm deformation described hereinafter, and then further subjected to tempering suitable for respective test pieces.

A test piece having the composition of $P_1$ was extruded to a degree of extrusion of 40% by applying a pressure of 50 kg/mm² at a temperature of 630° C in the axial direction of its cylinder. The test piece after being extruded was in the state of being pulverized into lumpy grains of 0.5 ~ 2 mm, not retaining its original configuration. From large grains of them, a piece the size of 1 mm cubic was cut out, to be further tempered at 500° C for 30 minutes. Measurements of its magnetic characteristics showed it to be isotropic, giving the following values:

Br = 1,200 G $_B$Hc = 400 Oe (BH)max = 0.1 × $10^6$G.Oe

The results of examination of this test piece by way of X-ray diffraction showed that it was mostly in the $\beta$-Mn phase and the AlMn($\gamma$) phase, with the remnant of the $\tau$ phase being small. This is believed to be because the decomposition from the $\epsilon$ phase and the $\tau$ phase to the AlMn($\gamma$) phase and the $\beta$-Mn phase was accelerated by the warm deformation.

A test piece having the composition of $P_2$ was compressed to a degree of deformation of −20% by applying a pressuring force of 45 kg/mm² at a temperature of 780° C in the axial direction of its cylinder. The test piece, after being compressed was found to be pulverized, not retaining its original shape. The results of examination of this test piece after being compressed showed no existence of the $\tau$ phase, but only the AlMn($\gamma$) phase and the $\beta$-Mn phase were recognized. This is believed to be because the decompositon from the $\tau$ phase to the AlMn($\gamma$) phase and the $\beta$-Mn phase was accelerated by the warm deformation.

A test piece having the composition of $P_3$ was compressed to a degree of deformation of −50% by applying a pressuring force of 40 kg/mm² at a temperature of 580° C in the axial direction of its cylinder. On the test piece after being compressed, a small number of cracks were detected in its diameter direction around its perimeter, its magnetism being slight. The magnetic characteristics of this test piece, as measured after tempering it at 570° C for 3 hours, showed its preferred direction of magnetization in its diameter direction, but were such low values as:

Br = 2,580 G, Hc = 1,400 Oe, BHmax = 1.3 × $10^6$G.Oe

The results of examination of the test pieces after being compressed and after being tempered showed it to have a large amount of the $\beta$-Mn phase, and this seems to account for the failure to achieve an improvement in its magnetic characteristics.

A test piece having the composition of $P_4$ was extruded to a degree of extrusion of 50% by applying a pressure of 40 kg/mm² at a temperature of 720° C in the axial direction of its cylinder. The test piece, after being extruded, by way of X-ray diffraction showed the existence of the $\epsilon'_c$ phase, besides the $Mn_3AlC$ phase. The magnetic characteristics of this test piece, as measured after tempering it at 550° C for 10 hours, were found in the extruding direction to be:

Br = 6,400 G, $_B$Hc = 2,550 Oe, (BH)max = 6.2 × $10^6$G.Oe

It was identified as a very excellent anisotropic magnet with its preferred direction of magnetization in the extrusion direction. As the phase structure of this test piece was examined by way of X-ray diffraction and optical microscopic observation, it was found to be in the $\tau_c$ phase and the $Mn_3AlC$ phase, and the streak pattern of the lamellar $Mn_3AlC$ phase running nearly parallel to the extruding direction was observed.

A test piece having the composition of $P_4$ was compressed to a degree of deformation of −45% by applying a pressuring force of 45 kg/mm² at a temperature of 650° C in the axial direction of its cylinder. The test piece after being compressed was tempered at 600° C for 3 hours, and then as the result of the measurement of its magnetic characteristics, it was identified as an anisotropic magnet with its preferred direction magnetization in its diameter direction. Its magnetic characteristics in the preferred direction of magnetization were found to be:

Br = 5,300 G $_B$Hc = 2,600 Oe (BH)max = 4.7 × $10^6$G.Oe

A test piece having the composition of $P_5$ was extruded to degree of extrusion of 50% by applying a pressure of 45 kg/mm² at a temperature of 630° C in the axial direction of its cylinder. As examined after tempering it at 550° C for 20 hours, it was identified to be an anisotropic magnet with its preferred direction of magnetization in the extruding direction, its characteristics were:

Br = 6,250 G, $_B$Hc = 2,500 Oe, (BH)max = 6.3 × $10^6$ G.Oe, $4\pi I_{10000}$ = 6,800 G, $_I$Hc = 2,800, Oe Br/$4\pi I_{10.000}$ = 0.92

A test piece having the composition of $P_5$ was extruded to a degree of extrusion of 40% in the axial direction of its cylinder, with the temperature varied in the range of 500° C to 850° C. In Table 7, its magnetic characteristics in the extruding direction as measured upon tempering it after the extruding, related to the working temperature, were shown. When the deforming temperature was below 500° C, it had little plasticity, just as in the cases of Examples 4 and 11, thus posing difficulty in its extrusion, showed notable development of cracks, and was not turned anisotropic by the tempering. Even at temperatures above 830° C, it showed a diminishing plasticity, with accompanying development of cracks, and failed to become anisotropic. In the temperature ranges of 530°~830° C, an excellent anisotropic magnet with (BH)max higher than $5.2 \times 10^6$G.Oe was obtained at a lower degree of extrusion than in the case of Example 11.

Table 7

| deforming temperature (° C) | Br (G) | $_B$Hc (Oe) | (BH)max ($\times 10^6$G.Oe) |
|---|---|---|---|
| 500 | 2700 | 1200 | 1.0 |
| 530 | 6000 | 1950 | 5.5 |
| 630 | 6300 | 2450 | 6.3 |
| 730 | 6150 | 2200 | 6.1 |
| 830 | 5700 | 2000 | 5.1 |
| 850 | 2800 | 1350 | 1.2 |

A test piece having the composition of $P_6$ was extruded to a degree of extrusion of 31% by applying a pressure of 40 kg/mm² at 650° C in the axial direction of its cylinder. After being extruded, it was tempered at 620° C for 2 hours, then was identified as an anisotropic magnet with its preferred direction of magnetization in the extrusion direction. Its magnetic characteristics in that direction were found to be:

Br = 6,300 G $_B$Hc = 2,150 Oe $(BH)_{max} = 5.3 \times 10^6$G.Oe

A test piece having the composition of $P_7$ was compressed to a degree of deformation of −35% by applying a pressuring force of 45 kg/mm² at a temperature of 800° C in the axial direction its cylinder. The test piece after being compressed was tempered at 550° C for 12 hours, and it was identified as an anisotropic magnet with its preferred direction of magnetization in the diameter direction. Its magnetic characteristics, however, were found to give such low values as:

Br = 1,950 G $_B$Hc = 1,050 Oe $(BH)_{max} = 0.7 \times 10^6$G.Oe

A test piece having the compositon of $P_8$ was compressed to a degree of deformation of −18% by applying a pressuring force of 50 kg/mm² at a temperature of 730° C in the axial direction of its cylinder. The test piece after being compressed was tempered at 570° C for 6 hours, and it was identified as an anisotropic magnet with its preferred direction of magnetization in the diameter direction. Its magnetic characteristics, however, were found to give such low values as:

Br = 3,350 G $_B$Hc = 1,900 Oe $(BH)_{max} = 1.7 \times 10^6$G.Oe

This test piece began disintegrating several days thence.

A test piece having the composition of $P_9$ was extruded to a degree of extrusion of 31% by applying a pressure of 55 kg/mm² at 780° C in the axial direction of its cylinder. The test piece after being extruded had lamellar cracks perpendicular to the extrusion direction. After tempering this alloy at 600° C for 4 hours, it was identified as an anisotropic magnet with its preferred direction of magnetization in the extrusion direction, but its magnetic characteristics were found to be such low values as:

Br = 3,700 G Hc = 2,200 Oe $(BH)_{max} = 2.1 \times 10^6$G.Oe

This test piece, too, began disintegrating several days thence.

Furthermore, as disc test pieces with their preferred direction of magnetization in the direction parallel to the disc surface were cut out from the respective test pieces having the above mentioned magnetic characteristics, and their magnetic torques were measured. Every test piece gave a unidirectional magnetic torque curve. The magnetic torques of these test pieces were found falling within the range of $0.63 \sim 0.86 \times 10^7$ dyne-cm/cm³. Then, if the degree of anisotropization is expressed by its ratio to the magnetic torque of $1.07 \times 10^7$ dyne-cm/cm² of the $\tau_c$ monocrystal of Example 3, all of these test pieces gave such high degrees of anisotropization as above about 0.6. Especially the test piece with $(BH)_{max} = 6.3 \times 10^6$G.Oe obtained by extruding an alloy of the composition of $P_5$ was found to have the high magnetic torque of $0.86 \times 10^7$ dyne-cm/cm³, and be excellent in orientation, and was thus identified as an anisotropic magnet having a very high degree of anisotropization.

As shown by the above described examples, the Mn-Al-C alloys having the $\epsilon_c$(M) phase excelled in plasticity in the temperature range of 530° ~ 830° C, and from these alloys, anisotropic magnets having very excellent magnetic characteristics were obtained by way of a warm plastic deformation and tempering after this deformation. In these instances, at a degree of deformation 20 ~ 30% lower than in the case of Example 11, anisotropic magnets having magnetic characteristics equal or 10 ~ 20% superior to those of Example 10, in comparison with the magnetic characteristics of the test piece in the $\tau_c$(M) phase of Example 11 were obtained.

Accordingly, as the condition for obtaining adequate anisotropic magnets having a composition falling within the range of Mn 68.0 ~ 73.0%, C(1/10 Mn - 6.6)%~(1/3 Mn - 22.2)% and the remainder Al, preferably, within the range of Mn 70.5 ~ 72.5%, C(1/10 Mn - 6.6)~(1/3 Mn ~ 22.2)% and the remainder Al, it is an indispensable matter in this instance also, and anisotropic magnets having such very excellent magnetic characteristics as $(BH)_{max}$ higher than $5.2 \times 10^6$G.Oe were obtained especially by way of extrusion performed at a degree of extrusion of 30 ~ 50%. Their mechanical strength and machinability, as measured after the warm deformation and additional tempering, showed a notable improvement, reaching results equal or superior to those in the cases of Examples 11, 12 and 13.

When the magnetic torques of the test pieces having magnetic characteristics of $(BH)_{max}$ higher than $4.8 \times 10^6$G.Oe obtained in the above mentioned Examples 11, 12, 13, 14 were measured, they all gave values higher than $0.43 \times 10^7$ dyne-cm/cm³ These test pieces thus all showed such high degree of anisotropization as above about 0.4, as the degree of anisotropization was expressed in terms of the ratio of these values to the constant of magnetic anisotropization of $1.07 \times 10^7$ dyne-cm/cm³ of the $\tau_c$ monocrystal of Example 3. Example 15:

The raw materials of Mn, Al and C were properly mixed, were melted at about 1,450° C in 30 minutes, thereby melting carbon fully into its solid solution, and were then, cast to form a rod shape casting of a Mn-Al-C alloy. The composition of the casting thus obtained was as shown in Table 8 in terms of the value of its chemical analysis.

Table 8

| Sample No. | Mn % | Al % | C % |
|---|---|---|---|
| 1 | 67.51 | 32.27 | 0.22 |
| 2 | 67.55 | 31.95 | 0.50 |
| 3 | 68.03 | 31.88 | 0.09 |
| 4 | 68.04 | 31.66 | 0.30 |
| 5 | 67.91 | 31.66 | 0.43 |
| 6 | 68.04 | 31.41 | 0.55 |
| 7 | 68.48 | 31.40 | 0.12 |

| Sample No. | Mn % | Al % | C % |
|---|---|---|---|
| 8 | 68.53 | 31.27 | 0.20 |
| 9 | 68.49 | 31.22 | 0.29 |
| 10 | 68.53 | 30.95 | 0.52 |
| 11 | 68.55 | 30.80 | 0.65 |
| 12 | 68.45 | 30.80 | 0.75 |
| 13 | 68.50 | 30.59 | 0.91 |
| 14 | 69.02 | 30.85 | 0.13 |
| 15 | 69.00 | 30.76 | 0.24 |
| 16 | 69.04 | 30.64 | 0.32 |
| 17 | 68.99 | 30.49 | 0.52 |
| 18 | 68.97 | 30.28 | 0.75 |
| 19 | 68.98 | 30.14 | 0.88 |
| 20 | 69.55 | 30.35 | 0.10 |
| 21 | 69.50 | 30.30 | 0.20 |
| 22 | 69.48 | 30.23 | 0.29 |
| 23 | 69.50 | 29.95 | 0.55 |
| 24 | 69.53 | 29.79 | 0.68 |
| 25 | 69.49 | 29.60 | 0.91 |
| 26 | 69.51 | 29.40 | 1.09 |
| 27 | 69.97 | 29.91 | 0.12 |
| 28 | 69.96 | 29.82 | 0.22 |
| 29 | 69.95 | 29.72 | 0.33 |
| 30 | 70.04 | 29.41 | 0.55 |

| Sample No. | Mn % | Al % | C % |
|---|---|---|---|
| 31 | 69.98 | 29.30 | 0.72 |
| 32 | 69.95 | 29.12 | 0.93 |
| 33 | 70.06 | 28.84 | 1.10 |
| 34 | 70.52 | 29.39 | 0.09 |
| 35 | 70.56 | 29.26 | 0.18 |
| 36 | 70.47 | 28.98 | 0.55 |
| 37 | 70.45 | 28.66 | 0.89 |
| 38 | 71.02 | 28.07 | 0.91 |
| 39 | 72.05 | 26.90 | 1.05 |

From each of these castings, a test specimen cubic in shape of 10 × 10 × 10 mm was cut off, was turned into the uniform $\epsilon$ phase or $\epsilon_c$ phase by way homogenization by heating at 1,150° C for 2 hours and then quenching from 900° C or more at a cooling rate higher than 10° C/min. in the temperature range of 830° C~900° C. After this heat treatment was carried out, each test specimen was examined by X-ray diffraction, optical microscopy and electron microscopy to determine its phase structure. The results were as follows:

1. Test specimens in which the existence of $Al_4C_3$ was recognized included those of Nos. 2, 6, 12, 13, 19 and 26.

2. Test specimens of those mentioned in (1) which had a matrix of $\epsilon_c$ single phase included those of Nos. 6, 12, 13, 19 and 26.

3. Test specimens in which deposition of AlMn($\gamma$) phase was recognized included those of Nos. 1, 2, 3 and 5.

4. Test specimens other than those mentioned in (1), (2) and (3) were all found to be $\epsilon$ or $\epsilon_c$ single phase.

These test specimens were tempered in the temperature range of 480° – 830° C. When the length of tempering time was 30 minutes, the magnetic properties appreciably decreased above 780° C in all test specimens of Nos. 1 ~ 39. The temperature range where the $\tau$ or $\tau_c$ stably existed greatly varied depending on the composition; when the tempering time length was 30 minutes, it was below 750° C.

The magnetic characteristics of each test specimen obtained when tempered at 700° C for 30 minutes were found to be as shown in Table 9.

Table 9

| Sample No. | Br (G) | $_{H}H_c$ (Oe) | $(BH)_{max}$ ($\times 10^6$G.Oe) |
|---|---|---|---|
| 1 | 100 | 50 | 0.0 |
| 2 | 500 | 150 | 0.0 |
| 3 | 1300 | 200 | 0.1 |
| 4 | 2600 | 550 | 0.5 |
| 5 | 1950 | 500 | 0.3 |
| 6 | 2500 | 550 | 0.4 |
| 7 | 1450 | 250 | 0.1 |
| 8 | 2200 | 450 | 0.3 |
| 9 | 3200 | 550 | 0.6 |
| 10 | 3200 | 600 | 0.7 |
| 11 | 3150 | 600 | 0.7 |
| 12 | 2950 | 550 | 0.6 |
| 13 | 2750 | 550 | 0.5 |
| 14 | 1500 | 250 | 0.1 |
| 15 | 2400 | 500 | 0.4 |
| 16 | 3250 | 500 | 0.6 |
| 17 | 3200 | 650 | 0.8 |
| 18 | 3150 | 600 | 0.7 |

| Sample No. | Br (G) | $_{H}H_c$ (Oe) | $(BH)_{max}$ ($\times 10^6$G.Oe) |
|---|---|---|---|
| 19 | 2900 | 600 | 0.6 |
| 20 | 1300 | 200 | 0.1 |
| 21 | 2350 | 400 | 0.3 |
| 22 | 2450 | 450 | 0.4 |
| 23 | 3200 | 600 | 0.7 |
| 24 | 3200 | 650 | 0.8 |
| 25 | 3000 | 650 | 0.7 |
| 26 | 2800 | 600 | 0.6 |
| 27 | 1250 | 250 | 0.1 |
| 28 | 2300 | 450 | 0.3 |
| 29 | 2600 | 450 | 0.4 |
| 30 | 3050 | 700 | 0.7 |
| 31 | 3100 | 850 | 0.9 |
| 32 | 2950 | 900 | 0.8 |
| 33 | 2800 | 1200 | 1.0 |
| 34 | 1000 | 200 | 0.1 |
| 35 | 1550 | 450 | 0.2 |
| 36 | 2700 | 1150 | 0.9 |
| 37 | 2600 | 1300 | 1.0 |
| 38 | 3200 | 1300 | 1.2 |
| 39 | 3150 | 1400 | 1.3 |

As a result of examination of the phase structure of each test specimen of Table 9 after being tempered, it was found out that in each test specimen of Nos. 1, 2, 3, 5, 7, 14, 20, 27, 34 and 35, i.e., test specimens of Mn less than 68.0% or C less than 0.2%, the AlMn ($\gamma$) phase or the $\beta$-Mn phase, or both, were observed, and the Br of these test specimens was found to be less than merely 2000 G. On the other hand, in test specimens other than those mentioned above, i.e., test specimens of Mn more than 68.0% or C more than 0.2%, the stability of $\tau$ and $\tau_c$ phase was satisfactory, and Br runs to 2,000 G or more, up to 750° C when the tempering time was 30 minutes, but as 750° C was exceeded, the transformation to the AlMn($\gamma$) and $\beta$-Mn phase began, as confirmed by the X-ray diffraction, optical microscopy and electron microscopy.

For the test specimen of No. 17, the magnetic characteristics and principal phase were observed after it was tempered for 30 minutes in the temperature range of 480° ~ 830° C. These results are shown in Table 10.

Table 10

| Code | Tempering temperature (° C) | Br (G) | $_BH_c$ (Oe) | $(BH)_{max}$ ($\times 10^6$G.Oe) | Phase structure |
|---|---|---|---|---|---|
| a | 480 | 2600 | 400 | 0.4 | $\tau_c$ |
| b | 500 | 2800 | 450 | 0.5 | $\tau_c$ |
| c | 550 | 3000 | 560 | 0.6 | $\tau_c$ |
| d | 600 | 3200 | 650 | 0.8 | $\tau_c$ |
| e | 650 | 3200 | 650 | 0.8 | $\tau_c$ |
| i | 700 | 3200 | 650 | 0.8 | $\tau_c$ |
| g | 750 | 3150 | 600 | 0.7 | $\tau_c$ |
| h | 780 | 1800 | 500 | 0.3 | $\tau_c$+AlMn($\gamma$)+$\beta$–Mn |
| i | 800 | 1000 | 250 | 0.1 | $\tau_c$+AlMn($\gamma$)+$\beta$–Mn |
| j | 830 | 100 | 50 | 0.0 | AlMn($\gamma$)+$\beta$–Mn+$\epsilon_c$ |

Example 16

From each of castings of Nos. 1 ~ 39 of Example 15, a cylindrical test specimen of 20mm$^{\phi}$ × 35 mm was cut out. It was subjected to the homogenization and quenching similarly as in Example 15, and was then, tempered at 600° C for 30 minutes; thereafter, it was extruded by an oil-hydraulic press at an extruding pressure of 12.6 tons, using a die with a surface reduction percentage of 75% in the temperature range of 500° ~ 800° C.

At an extruding temperature below 530° C, all test specimens were pulverized, so that no test pieces for the measurement of magnetic characteristics could be taken. At temperatures above 530° C but below 600° C, the test pieces either cracked or did not. Even when no cracking occurred, the deformability was low, and the degree of anisotropization, e.g., the ratio of $(BH)_{max}$ between the extrusion direction and the direction at a right angle thereto, was small.

In the temperature range exceeding 780° C, in all test specimens, except for No. 38, 39 the transformations to the AlMn($\gamma$) phase and $\beta$-Mn phase took place; the magnetic property rapidly decreased, and the degree of anisotropization also diminished.

On the other hand, as for the relationship between the composition and the magnetic characteristics, when C is 0.2 ~ (1/3 Mn ~ 22.2)%, the degree of anisotropization was high; in the range of 68.0 ~ 70.5% Mn, and an anisotropic magnet with preferred direction of magnetization in the extrusion direction was obtained.

With the amount of Mn more than 70.5% but less than 73.0%, only a small degree of anisotropization took place or anisotropization did not occur.

The test specimen of No. 17 of Example 15 was subjected to homogenization and quenching treatment similarly as in Example 15 and to a tempering at 600° C for 30 minutes after a quenching, and in the same way as in the preceding example, was extruded by an extruding pressure of 12.6 tons at a surface reduction percentage of 75%. The magnetic characteristics in the extrusion direction obtained after these treatments were carried out were as shown in Table 11.

Table 11

| Code | Processing temperature (° C) | Br (G) | $_BH_c$ (Oe) | $(BH)_{max}$ ($\times 10^6$G.Oe) |
|---|---|---|---|---|
| a | 500 | — | — | — |
| b | 530 | 3150 | 1350 | 1.5 |

Table 11-continued

| Code | Processing temperature (° C) | Br (G) | $_BH_c$ (Oe) | $(BH)_{max}$ ($\times 10^6$G.Oe) |
|---|---|---|---|---|
| c | 580 | 3200 | 1500 | 1.8 |
| d | 590 | 5050 | 1650 | 3.3 |
| e | 600 | 6200 | 1960 | 5.5 |
| f | 650 | 6450 | 2500 | 6.7 |
| g | 700 | 6450 | 2550 | 6.8 |
| h | 750 | 6350 | 2400 | 6.5 |
| i | 780 | 6350 | 2300 | 6.3 |
| j | 790 | 4950 | 1900 | 3.7 |
| k | 800 | 2300 | 1300 | 0.8 |

The test specimen of code a was pulverized, so that its magnetic characteristics could not have been measured. The test specimens of Codes *b*, *c* and *k* were almost isotropic, and the test specimens of d and j were lower in the degree of anisotropization than those of e ~ j.

That is to say, only by the warm deformation at 600° ~ 780° C, preferably 650° ~ 780° C, anisotropic magnets showing a high degree of anisotropy were obtained.

All of the test specimens of Nos. 1 ~ 39 of Example 15 were tempered at 600° C for 30 minutes after subjecting them to the homogenization and quenching similarly as in Example 15, and were then, extruded at 700° C by a pressure of 12.5 tons with a surface reduction percentage of 75%. The magnetic characteristics in the extrusion direction of the test specimen treated in this way were as shown in Table 12.

Table 12

| Sample No. | Br (G) | $_BH_c$ (Oe) | $(BH)_{max}$($\times 10^6$ G.Oe) |
|---|---|---|---|
| 1 | 0 | 0 | 0 |
| 2 | 200 | 50 | 0.0 |
| 3 | 1050 | 400 | 0.1 |
| 4 | 6200 | 2200 | 6.0 |
| 5 | 1500 | 700 | 0.4 |
| 6 | 4350 | 1700 | 3.8 |
| 7 | 1150 | 500 | 0.2 |
| 8 | 4900 | 1600 | 4.1 |
| 9 | 6300 | 2300 | 6.2 |
| 10 | 6400 | 2400 | 6.5 |
| 11 | 6250 | 2400 | 6.3 |
| 12 | 4300 | 1800 | 4.0 |
| 13 | 3350 | 2200 | 2.2 |
| 14 | 1200 | 550 | 0.3 |
| 15 | 4950 | 1850 | 4.3 |
| 16 | 6400 | 2400 | 6.5 |
| 17 | 6450 | 2550 | 6.8 |
| 18 | 6300 | 2500 | 6.4 |
| 19 | 5050 | 2350 | 4.7 |
| 20 | 1200 | 450 | 0.2 |
| 21 | 4050 | 1600 | 3.7 |
| 22 | 4800 | 1900 | 4.5 |
| 23 | 6500 | 2600 | 7.1 |
| 24 | 6450 | 2600 | 7.0 |
| 25 | 6300 | 2550 | 6.3 |
| 26 | 5350 | 2250 | 4.8 |
| 27 | 1150 | 600 | 0.3 |

Table 12-continued

| Sample No. | Br (G) | $_BH_c$ (Oe) | $(BH)_{max}$ ($\times 10^6$ G.Oe) |
|---|---|---|---|
| 28 | 4550 | 1700 | 4.0 |
| 29 | 4800 | 1950 | 4.2 |
| 30 | 6000 | 2400 | 5.9 |
| 31 | 6250 | 2450 | 6.4 |
| 32 | 6100 | 2400 | 6.0 |
| 33 | 5800 | 2350 | 5.5 |
| 34 | 800 | 450 | 0.1 |
| 35 | 1500 | 700 | 0.4 |
| 36 | 5950 | 2250 | 5.5 |
| 37 | 5700 | 2100 | 5.2 |
| 38 | 3300 | 2450 | 2.4 |
| 39 | 3350 | 2500 | 2.5 |

The results of examination of the phase structure as conducted by way of X-ray diffraction, optical microscopy and electron microscopy were as follows:

1 Test specimens in which one of the AlMn($\gamma$) phase or $\beta$-Mn phase, or both, were recognized in large amounts included those of Nos. 1, 2, 3, 5, 7, 14, 20, 27, 34 and 35, i.e., those test specimens of Mn being less than 68.0% or C less than 0.2%. From the result of X-ray diffraction of those test specimens, the amount of $\tau$ phase was found to have appreciably decreased from those given in Table 9.

2 Test specimens in which $Al_4C_3$ was recognized by optical microscopy included those of Nos. 2, 6, 12, 13, 19 and 26, i.e., those test specimens with their compositions falling in the range of C exceeding (1/3 Mn – 22.2)%.

These test specimens began decaying several days several weeks later. In test specimens in which $Al_4C_3$ existed, their plasticity declined, and the degree of anisotropization also diminished.

3. In test specimens other than those of (1) and (2) mentioned above, i.e., those test specimens of Nos. 4, 8, 9, 10, 11, 15, 16, 17, 18, 21, 22, 23, 24, 25, 26, 28, 29, 30, 31, 32, 33, 36, 37, 38, and 39, on the main, only $\tau$ or $\tau_c$ phase was recognized.

4. In test pieces of aforementioned in (3), $Mn_3AlC$ and/or face centered cubic phase being similar thereto were found in test pieces of Nos. 4, 9, 10, 11, 16, 17, 18, 23, 24, 25, 30, 31, 32, 33, 36, 37, 38, and 39, which have composition including an amount of carbon more than (1/10 Mn - 6.6)% respectively, and it was recognized such a tendency that the amount of $Mn_3AlC$ and/or face-centered cubic phase being similar thereto were slightly greater than that existing in the test pieces before warm deformation.

Similarly, in the composition range of Mn 68.0 ~ 70.5%, C(1/10 Mn - 6.6) ~ (1/3 Mn - 22.2)% and remainder Al, anisotropic magnets obtained by plastically deforming the alloys in this example which were quenched and tempered, were excellent in magnetic characteristics compared to anistropic magnets obtained by plastically deforming the alloys tempered after M treatment mentioned in Example 11.

The cause of this is unknown, but in case of Example 11, it is surmised that slight presence of the AlMn ($\gamma$) phase reduces the degree of anisotropization, because, in the composition range, AlMn ($\gamma$) phase could be found in the phase existing in test pieces of Example 11 before plastic deformation thereof, but could not be found in the phase of this example.

Also, in range of Mn 70.5 ~ 73.0%, C(1/10 Mn – 6.6)~ 1/3 Mn – 22.2)%, the remainder being Al, the test pieces of this Example are slightly or not at all turned into anisotropic. It is considered that the reason for this is the presence of great quantities of spherodized $Mn_3AlC$, and few amount of lamellar $Mn_3AlC$ and/or face-centered cubic phase (the latter being similar thereto) exists in alloys before plastic deformation thereof.

EXAMPLE 17

The test specimen of No. 23 of Example 16 was further tempered at 550° C for 30 ~ 240 minutes after having been extruded as in Example 16. The magnetic characteristics in the extrusion direction obtained as the result was as shown in Table 13.

Besides, in the case of varying the temperature for tempering in the temperature range of 480° ~ 750° C, magnetic characteristic thereof were improved more than just after extrusion by holding it under tempering conditions for a proper time.

Table 13

| Code | Tempering time length (min) | Br (G) | $_BH_c$ (Oe) | $(BH)_{max}$ ($\times 10^6$ G.Oe) |
|---|---|---|---|---|
| a | 30 | 6600 | 2750 | 7.8 |
| b | 60 | 6600 | 2750 | 7.8 |
| c | 120 | 6500 | 2600 | 7.1 |
| d | 240 | 6150 | 2200 | 5.9 |

EXAMPLE 18

From the casting of No. 24 of Example 15, test specimens, each of 20 mm$\phi$ × 35 mm were cut out. They were tempered at 600° C for 30 minutes after subjecting them to a quenching similarly as in Example 15. Thereafter, one part was extruded at a pressure of 12.5 tons, using a die with a surface reduction percentage of 65% at a temperature of 730° C. The magnetic characteristics in the extrusion direction were found to be:

Br = 6450G $_BHc$ = 2250 Oe $(BH)_{max} = 6.8 \times 10^6$ G.Oe.

The other part was similarly extruded to a surface reduction percentage of 25% at 730% C, and then, was further extruded, so that the surface reduction percentage would be 65% in total at the same temperature.

The magnetic characteristics in the extrusion direction after the second extrusion was conducted were found to be:

Br = 6450 G $_BHc$ = 2600 Oe $(BH)_{max} = 7.1 \times 10^6$ G.Oe

The magnetic characterisitics in the extrusion direction obtained by further subjecting the test specimen twice extrude to an annealing at 550° C for 30 minutes, were found to be:

Br = 6500 G $_BHc$ = 2700 Oe $(BH)_{max} = 7.5 \times 10^6$ G.Oe.

A larger improvement was achieved in $(BH)_{max}$ when the extrusion was made in more than 2 cycles than when it was conducted in 1 cycle.

EXAMPLE 19

The test specimen of No. 39 of Example 15 was extruded under the same conditions as in Example 18.

After the extrusion to a surface reduction percentage of 65% the magnetic characteristics both in the extrusion direction and in right angles to the extrusion direction were:

Br = 3300 G $_BHc$ = 2450 Oe $(BH)_{max} = 2.3 \times 10^6$ G.Oe

The magnetic characteristics obtained after the second extrusion to a total surface reduction percentage of 65% (the extrusion being conducted in the same way as in Example 18) both in the extrusion direction and in right angles to the extrusion direction, were:

Br = 3350 G $_B$Hc = 2400 G $(BH)_{max}$ = 2.3 × $10^6$ G.Oe

The magnetic characteristics in the extruding direction of the test specimen which had been subjected to the second extrusion, as obtained after further tempering it at 550° C for 30 minutes, were found to be: Br = 3200 G $_B$HC = 2200 Oe $(BH)_{max}$ = 2.0 × $10^6$ G.Oe

EXAMPLE 20

A rod shape test specimen consisting of Mn 67.5 ~ 73.0%, C(1/5 Mn – 13.3) ± 0.03% on the basis of the amount of Mn and the balance being Al was cast similarly as in Example 15, and from this casting, a cylindrical test piece of 20mm $\phi$ × 35mm was cut out. It was subjected to the homogenization treatment and quenching, as in Example 15 and was then tempered at 600° C for 30 minutes. The test piece thus tempered was extruded at 730° C by a pressure of 12.5 tons to a surface reduction percentage of 75%.

Figure 7:
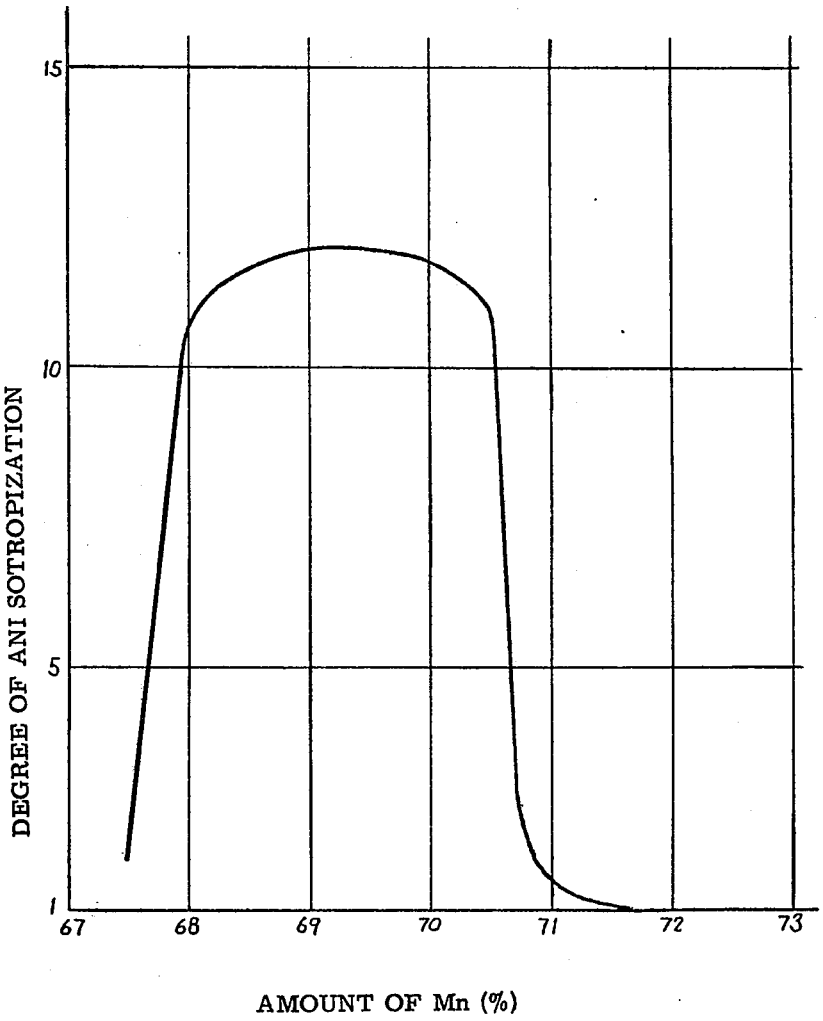
FIG. 7 depicts the relationship between the amount of Mn and the degree of anisotropization.

For the test piece which had gone through the treatments mentioned above, the relationship between the amount of Mn and the degree of anisotropization was found to be as shown in FIG. 7. Thus, a very high degree of anisotropization was achieved in the range of Mn being 68.0 ~ 70.5%.

The degree of anisotropization was, as in the preceding description, expressed by the ratio of $(BH)_{max}$ between the extruding direction, i.e., the axial direction of the test piece, and the direction at a right angle to the extruding direction, i.e., the direction of the diameter of the test piece.

EXAMPLE 21

From the casting of No. 24 of Example 15, a test piece of 20 mm $\phi$ × 35mm was cut out. It was subjected to the homogenizing treatment and quenching similarly as in Example 15, and then, extruded by a pressure of 15 tons, using a die having a reduction percentage of 75% at 700° C theirafter tempered at 600° C for 30 minutes. The magnetic characteristics in the extruding direction of the test piece obtained in this way were found to be:

Br = 6600 G $_B$Hc = 2300 Oe $(BH)_{max}$ = 6.8 × $10^6$ G.Oe

EXAMPLE 22

From the casting of No. 10 of Example 15, a test piece of 20 mm $\phi$ × 35 mm was cut out. It was tempered at 550° C for 30 minutes after subjecting it to the homogenization treatment and quenching similarly as in Example 15, and was then upset, using a die of 40mm $\phi$ at 750° C. The test piece of 40 mm $\phi$ × 8.8mm formed showed no crack at all. From the outer peripheral part of this test piece, a cube of 8.8 × 8.8 × 8.8 mm was cut out. By the measurement of its magnetic characteristics, it was found out to be an anisotropic magnet with its preferred direction of magnetization in its diameter direction. The magnetic characteristics in the preferred direction of magnetization observed were:

Br=5500 G $_B$HC=2400 Oe $(BH)_{max}$=5.3 ×$10^6$ G.Oe.

By plastic deformation, magnetic anisotropization and formation into predetermined shape are carried out at the same time.

EXAMPLE 23

A square pillar shape test piece of 30 × 30 × 150 mm having a composition ratio of Mn 69.28%, Al 30.28% and C 0.49%, as chemically analyzed, was cast. After subjecting it to a homogenization at 1,150° C for 2 hours, it was quenched from 1,000° C to 600° C at a cooling rate of about 400° C/min., and was then tempered at 600° C for 30 minutes. This test piece was rolled in 5 cycles to a thickness of 10 mm on grooved rolls of 30 mm groove width without crack.

The formed test piece turned out to be an anisotropic magnet with its preferred direction of magnetization in the rolling direction of magnetization were found to be:

Br = 6450 G $_B$HC = 2500 Oe $(BH)_{max}$ = 6.6 × $10^6$ G.Oe.

EXAMPLE 24

From the casting of No. 16 of Example 15, a cylindrical test piece of 20mm $\phi$ × 35mm was cut out. It was subjected to the homogenization and quenching similarly as in Example 15, and was then extruded at 700° C and at a pressure of 12.5 tons, while applying a magnetic field of 3,000 Oe in the extrusion direction by use of a solenoid and was then tempered at 600° C for 30 minutes. The test piece obtained in this way turned out to be an anisotropic magnet with its preferred direction of magnetization in the extruding direction. The magnetic characteristics in the extrusion direction were found to be:

Br = 6550 G $_B$Hc = 2250 Oe $(BH)_{max}$ = 6.8 × $10^6$ G.Oe

EXAMPLE 25

From the casting of No. 10 of Example 15, a test piece of 10mm $\phi$ × 20mm was cut out. It was tempered at 600° C for 30 minutes after subjecting it to the homogenization treatment and quenching similarly as in Example 15. It was then, extruded at 700° C, using a die having reduction percentage of 75%, with an ultrasonic vibration applied either on the die or punch, while making th extrusion.

The magnetic characteristics observed in the extruding direction when a vibration of 27 KHz was applied were:

Br = 6350 G $_B$Hc = 2600 Oe $(BH)_{max}$ = 6.8 × $10^6$ G.Oe

EXAMPLE 26

From the casting of No. 16 of Example 15, a test piece of 10 mm$\phi$ × 20mm was cut out. It was tempered at 600° C for 1 hour after subjecting it to the homogenizing treatment and quenching similarly as in Example 15, and was then, extruded at a high speed at 750° C, using a die having a reduction percentage of 75%. When the extrusion speed was 10 m/sec., the magnetic characteristics in the extrusion direction were found to be:

Br = 6200 G $_B$HC = 2600 Oe $(BH)_{max}$ = 6.4 × $10^4$ G.Oe.

The test piece could be formed without a crack.

EXAMPLE 27

The mechanical properties of the conventional isotropic Mn-Al-C magnets were superior to those of the mn-Al magnets, but they could be machined on lathes, etc., only with difficulty, their mechanical strength lying at such a low level as tensile strength 2 kg/mm², elongation 0 and transverse strength 7 kg/mm².

On the other hand, in the test pieces after having undergone the respective treatments of each embodiment of this invention described in the foregoing, had mechanical strengths which were remarkably improved, reaching high levels such as tensile strength 20 ~ 30 kg/mm², elongation 3 ~ 5% and transverse strength 30 ~ 40 kg/mm², and because of their highly improved machinability, such machining treatments as ordinary lathing, drilling by use of drilling machines etc., could be performed with ease even in their state of being magnetized.

EXAMPLE 28

A rod shape casting of an Mn-Al alloy having a composition of Mn 71.62% and Al 28.38%, as chemically analyzed, was manufactured by way of melting and casting. From this casting, a cylindrical test piece of 20mm $\phi$ × 36mm was cut out, and after holding it at a temperature of 1,000° C for 1 hour, was quenched into water. The test piece after being quenched showed a development of numerous cracks. The test piece after being quenched, was examined by way of X-ray diffraction as to its phase structure, and was found to be in the $\epsilon$ phase only.

This cylindrical test piece in the $\epsilon$ phase was compressed to a degree of deformation of −50% by applying a pressuring force of 45 kg/mm² at a temperature of 650° C in the axial direction of its cylinder. The test piece after being compressed was found to be isotropic, giving low magnetic characteristics as:

Br = 1,300 G $_B$HC = 800 Oe $(BH)_{max}$ = 0.3 × $10^6$ G.Oe.

The test piece after compression, was examined by X-ray diffraction and showed the existence of the $\beta$-Mn phase and AlMn($\gamma$) phase in abundance.

And then from a rod shape casting of a Mn-Al alloy having a composition of Mn 69.05% and Al 30.96%, as chemically analyzed, a cylindrical test piece of 20mm $\phi$ × 35mm was cut out. The test piece was quenched into water after holding it at 1,000° C for 1 hour. The phase structure of the test piece which had been quenched into water was found to be in the $\epsilon$ single phase, as determined by X-ray diffraction. It was tempered into the $\tau$ phase, and was, then, extruded at 650° C by a pressure of 16 tons to a reduction percentage of 64%. The test piece formed was isotropic, and its magnetic characteristics were found to be:

Br = 900 G $_B$Hc 450 Oe $(BH)_{max}$ = 0.1 × $10^6$ G.Oe.

As revealed by the X-ray diffraction of the test piece after having been treated, large amounts of $\beta$-Mn phase and AlMn($\gamma$) phase were recognized, but the $\gamma$ phase was found only in a very small amount.

Furthermore, the results were nearly the same when the composition of Mn and Al, the condition of heat treatment and the conditions of treatments were altered; it was impossible to achieve a magnetic characteristic of $(BH)_{max}$ above 1.0 × $10^6$G.Oe, and its mechanical strength was termed very brittle.

As described hereinabove, the Mn-Al alloys, the stability of the $\epsilon$ phase and $\tau$ phase was not only lower than in the Mn-Al-C alloys containing an amounts of carbon in excess of its solid solution limit, but the strain induced transformation was promoted when the treatment was performed in temperature ranges above 530° C, so that it was virtually impossible to preserve the $\tau$ phase, and moreover, anisotropization was not obtained because of absence of the orientation control effect whereby the degree of orientation increases by the presence of lamellar $Mn_3AlC$ phase.

EXAMPLE 29

A similar experiment to those of Examples 11, 14 and 16 was carried out with an Mn-Al-C-X alloy(s) manufactured by adding an additive element(s) X to the Mn-Al-C alloy.

An Mn-Al-C-Nb alloy in the shape of a cylinder of 20mm × 35mm having a composition of Mn 71.47%, Al 25.06%, C 1.03% and Nb 2.44%, as chemically analyzed, with Nb chosen as X, was manufactured by melting, casting and heat treatment in a manner similar to that of Example 11. This alloy, was determined by X-ray diffraction and optical microscopy to be mainly in the $\tau_c$(M) phase.

As this test piece was compressed to a degree of deformation of −65% in the axial direction of its cylinder under a pressure of 45 kg/mm² and temperature of 680° C. The test piece after being worked on was identified as an anisotropic magnet with its preferred direction of magnetization in the diameter direction, having the following magnetic characteristics in that direction:

Br = 5,200 G Hc = 2,800 Oe $(BH)_{max}$ = 4.9 × $10^6$ G.Oe

Thus, an improvement in $(BH)_{max}$ was recognized over the magnetic characteristic obtained in the similar experiment with an Mn-Al-C alloy of Example 11.

Next, a cylindrical Mn-Al-C-Nb alloy of 20mm $\phi$ x 35mm consisting of Mn 69.69%, Al 21.14%, C 0.72% and Nb 0.56% in the composition ratio, as chemically analyzed, with Nb chosen as X, was melted, and cast, and then, subjected to the homogenization and quenching in the same way as in Examplle 15. This test piece was tempered at 600° C for 30 minutes. Then, as its phase structure was examined by X-ray diffraction, the AlMn($\gamma$) phase and $\beta$-Mn phase were not recognized, but mainly the $\tau$ phase only was detected.

When this test piece was extruded at 700° C by a pressure of 15 tons to the reduction percentage 75%, the test piece formed turned out to be an anisotropic magnet with its preferred direction of magnetization in the extrusion direction. Its magnetic characteristics in the preferred direction of magnetization were found to be:

Br = 6200 G $_B$Hc = 2600 Oe $(BH)_{max}$ = 6.7 × $10^6$ G.Oe.

This shows an improvement in $(BH)_{max}$ over the result with the test piece of No. 31 of Example 16.

In the next place, various Mn-Al-C-X alloys in which such additive elements X as B, N, Ti, Pd, Bi, V, Ag, Fe, Mo, Ni Ge, Nb, Co, Pb, Zn, S, Ce and Sm, were added, singly or in combination of more than 2 of them, at weight ratios within 6, with the Mn-Al-C alloys as 100 having their composition falling within

| | |
|---|---|
| Mn | 68.0~73.0% |
| C | (1/10Mn - 6.6)%~ (½Mn - 22.2)% |
| Al | remainder |

were manufactured, and with these alloys, similar experiments as those of Examples 11, 14 and 16 were conducted. The results were especially notable in that the Mn-Al-C-(Nb-30 Mo) alloy with a 2.0% Nb and a 0.5% Mo weight ratio showed an improvement of about 10% in $(BH)_{max}$ over the results in the cases of Examples 11 and 14, and also in Mn-Al-C-X alloys containing the additive elements of B, Ti, Fe, Mo, Ge, Co, Ni and Nb singly or in combination of more than 2, upgradings in magnetic characteristics were noted.

Furthermore, in Mn-Al-C-Pb alloys with Pb added in 3.0 by weight ratio, their magnetic characteristics were found nearly equal or somewhat inferior to those obtained in Examples 11 and 14, but their plasticity was notably better. Such a tendency was observed also in Mn-Al-C-Zn alloys containing Zn as the additive.

Also, improved magnetic characteristics were observed in Mn-Al-C-B-Ti alloys with an 0.2% Ti and 0.3% B weight ratio, i.e. the $(BH)_{max}$ was improved by about 10 percent over that of the alloy of Example 16. And also, in Mn-Al-C-X alloys containing additive elements of B, Ti, Ni, Fe, Mo, Ge, Nb and Co, added singly or in combination within 3 by weight ratio to Mn-Al-C alloy as 100, improved magnetic characteristics were recognized.

Furthermore, in Mn-Al-C-Pb alloys with Pb added 2.0% in weight ratio, their magnetic characteristics were nearly equal to or slightly less than those of Example 16, but they had notably enhanced plasticity. Such a tendency was observed also where Zn was added, i.e. Mn-Al-C-Zn alloys.

As clarified by various examples described hereinabove, the abnormally large plasticity at 530 ~ 830° C of the Mn-Al-C alloys consisting of Mn 68.0 ~ 73.0%, C(1/10Mn ~ 6.6)% ~ (1/3Mn – 22.2)% and remainder Al is based on the phasal transformation of $\epsilon_c \rightarrow \epsilon'_c \rightleftarrows \tau_c$ inducted by the plastic deformation and especially on the abnormally large anistropic plasticity of the $\epsilon'_c$ phase. The phenomenon of this abnormal plasticity is called transformation plasticity. The notable anisotropization effected by the warm plastic deformation making use of this transformation plasticity results from the sliding of the plane of atoms of the following crystal plane:

$\epsilon_c(0001) // \epsilon'_c(100) // \tau_c(111)$, particularly in the direction toward [001] on the $\epsilon'_c$ (100) plane, which accompanies the above described phase transformation, as detailed with regard to the mechanisms of deformation, transformation and magnetism in Examples 3, 4 and 5. Accordingly, by having the lamellar $Mn_3AlC$ phase on the $\epsilon_c(0001)$ plane, it is possible to give priority to the desirable sliding of the plane of atoms on the aforementioned crystal planes, so that the degree of anisotropization may be notably increased by taking advantage of that orientation controlling effect of the lamellar $Mn_3AlC$.

Figure 8:
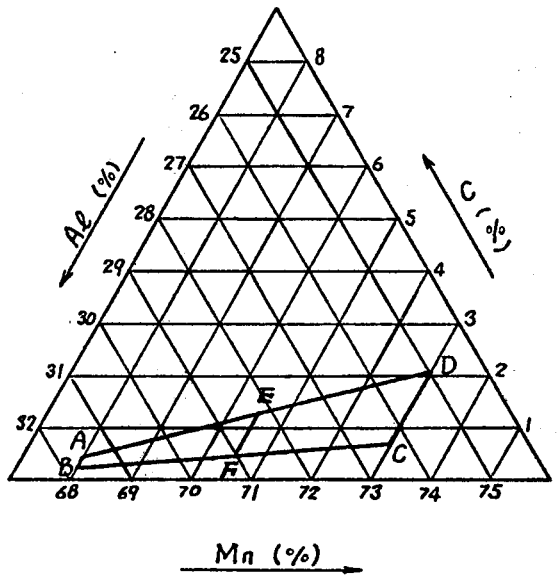
FIG. 8 represents a composition diagram of a Mn-Al-C ternary system.

The present invention relates to anisotropic Mn-Al-C alloys obtained by subjecting the alloys having compositions within the ranges enclosed by the lines connecting the points A, B, C and D, as represented in the Mn-Al-C ternary diagram of FIG. 8, that is the composition range of Mn 68.0 ~ 73.0%, C(1/10 Mn – 6.6) ~ (1/3 Mn –22.2)% and remainder Al, by subjecting them to transformation plasticity based on the phase transformation at 530 ~ 830° C.

Particularly, in the composition range enclosed by lines connecting the points E, F, C and D as shown in the diagram of FIG. 8, that is the composition range of Mn 70.5~73.0%, C(1/10Mn – 6.6) ~ (1/3Mn – 22.2)%, and remainder Al, by separating the lamellar $Mn_3AlC$ phase before warm plastic deformation, the degree of anisotropization mentioned above may be remarkably increased.

Moreover, in the composition range enclosed by lines connecting the points A, B, F, and E as shown in the diagram of FIG. 8, that is the composition range of Mn 68.0 ~ 70.5%, C(1/10Mn ~ 6.6) ~ (1/3Mn – 22.2)% and remainder Al, by warm plastic deformation of the alloy including phase, particularly the phase having adequate amount of C obtained by heat treatment, a magnet having very high degree of anistropization and having excellent magnetic characteristics may be obtained.

Although the mechanisms regarding polycrystals can hardly be clarified quantitatively, various phenomena described in the aforementioned Examples may be interpreted qualitatively by the similar mechanisms of deformation, transformation and magnetism as those of monocrystals. Thus, because polycrystals generally require the deformation needed for the rotation and movement of the grain boundary, in addition to the anisotropic deformation in each crystal grain, they must be worked on to a greater extent than monocrystals. Moreover, their magnetic characteristics are improved at a degree of deformation of 30 ~ 65%; and because of their being polycrystalline, the degrees of anisotropization attained with them are 30 ~ 40% smaller than those with monocrystals, but the composition range, phase structure and the deforming temperature range required for the realization of the above described phenomen were confirmed to be really the common essentials. And then, it was considered that mechanism of anisotropization is not only based on texture induced by working.

That the existence of carbon in excess of its solubility limit and the state of its existance are among the important indispensable factors in attaining such unexpectedly notably anisotropization as above described based on the mechanisms of deformation, transformation and magnetism, was definitely indicated by various examples hereabove described.

According to this invention, mechanical strengths of anisotropic magnets giving very higgh degrees of anisotropization with $(BH)_{max}$ running from 4.8 ~9.2 × $10^6$G.Oe, were 4 ~10 times as high as those of convenntional Mn-Al-C magnets; they had such high toughness that they could be subjected to such machining as the ordinary lathing; excelled in weather resistance, corrosion resistance, stability and temperature characteristics, and they were thus of high industrial value.

Furthermore, this invention has made it possible to apply not only the extrusion and compression, but all other plastic deformation, as well, including, for example, the wire drawing, drawing, rolling, die rolling, die upsetting, etc., and accordingly, while opening the way for the possibility of cutting the workpieces magnetized, it provides anisotropic magnets with their preferred direction of magnetization in any arbitrary directions in desired shape.

The embodiments of the invention in which an exclusive property or privilege is claimed are defined as follows:

1. A method of making an anisotropic permanent magnet comprising the steps of subjecting an alloy comprising 68.0% to 73.0% by weight of manganese, (1/10 Mn–6.6)% to (1/3 Mn – 22.2)% by weight of carbon and the remainder aluminum to plastic deformation at a temperature of 530° to 830° C in order to make the alloy magnetically anisotropic.

2. A method according to claim 1 further comprising the step of tempering the deformed alloy at a temperature of 480° to 750° C.

3. A method according to claim 1, wherein the alloy in the step before deformation has a hexagonal phase.

4. A method according to claim 1, wherein the alloy in the step before deformation has a orthorhombic phase.

5. A method according to claim 3, wherein the alloy of the hexagonal phase is a single crystal.

6. A method according to claim 5, wherein the single crystal contains lamellae of a compound $Mn_3AlC$ and/or a face-centered cubic phase which is similar to the compound $Mn_3AlC$.

7. A method of according to claim 5, wherein a crystal direction of the single crystal is determined by utilizing the orientation between the matrix of the crystal and the lamellae.

8. A method of making an anisotropic permanent magnet, comprising the steps of subjecting an alloy comprising the composition of 68.0% to 73.0% by weight of manganese, (1/10 Mn – 6.6)% to (1/3 Mn – 22.2)% by weight or carbon and the remainder aluminum to the steps of:

a. precipitating lamellae of a compound $Mn_3AlC$ and/or a face-centered cubic phase which is similar to the compound $Mn_3AlC$ in the alloy; and then b. deforming plastically the alloy at a temperature of 530° to 830° C in order to make the alloy magnetically anisotropic.

9. A method according to claim 8, further comprising the step of tempering the deformed alloy at a temperature of 480° to 750° C.

10. A method according to claim 8, wherein the precipitating step (a) is performed by cooling the alloy from 900° to 830° C at a cooling rate of 10° C/min. or less.

11. A method according to claim 8, wherein the precipitating step (a) is performed by holding the alloy at a temperature of 830° to less than 900° C for 7 minutes or more.

12. A method of making an anisotropic permanent magnet, comprising the steps of subjecting an alloy comprising the composition of 68.0% to 70.5% by weight of manganese, (1/10 Mn – 6.6)% to (1/3 Mn – 22.2)% by weight of carbon and the remainder aluminum to plastic deformation at a temperature of 600° C to 780° C in order to make the alloy magnetically anisotropic.

13. A method according to claim 12, further comprising the step of tempering the deformed alloy at a temperature of 480° to 750° C.

14. A method of making an anisotropic permanent magnet comprising the steps of subjecting an alloy comprising the composition of 68.0% to 70.5% by weight of manganese, (1/10 Mn – 6.6)% to (1/3 Mn – 22.2)% by weight of carbon and the remainder aluminum to:

a. quenching at a temperature of from 900° C or more;

b. deforming plastically the quenched alloy at a temperature of 600° C to 780° C in order to make the alloy magnetically anisotropic.

15. A method according to claim 14, further comprising the step of tempering the deformed alloy at a temperature of 480° to 750° C.

16. A method of making an anisotropic permanent magnet having a predetermined shape, comprising the steps of forming an alloy comprising the composition of 68.0% to 73.0% by weight of manganese, (1/10 Mn – 6.6)% to (1/3 Mn – 22.2)% by weight of carbon and the remainder aluminum into predetermined shape by deforming plastically the alloy at a temperature of 530° C to 830° C in order to make the alloy magnetically anisotropic in one or more preferred directions.

17. A method according to claim 16, further comprising the step of tempering the formed alloy at a temperature of 480° to 750° C.

18. A method according to claim 14, further comprising the step of tempering the quenched alloy at a temperature of 480° to 750° C before deformation.

* * * * *